US009280074B2

(12) United States Patent
Minaki et al.

(10) Patent No.: US 9,280,074 B2
(45) Date of Patent: Mar. 8, 2016

(54) TONER BINDER AND RESIN PARTICLE

(71) Applicant: Sanyo Chemical Industries, Ltd., Kyoto (JP)

(72) Inventors: Masashi Minaki, Kyoto (JP); Tsuyoshi Izumi, Kyoto (JP); Taiji Yamashita, Kyoto (JP)

(73) Assignee: Sanyo Chemical Industries, Ltd., Kyoto (JP)

( * ) Notice: Subject to any disclaimer, the term of this patent is extended or adjusted under 35 U.S.C. 154(b) by 0 days.

(21) Appl. No.: 14/211,315

(22) Filed: Mar. 14, 2014

(65) Prior Publication Data

US 2014/0272699 A1 Sep. 18, 2014

(30) Foreign Application Priority Data

Mar. 15, 2013 (JP) ..... 2013-052595

(51) Int. Cl.
*G03G 9/08* (2006.01)
*G03G 9/087* (2006.01)

(52) U.S. Cl.
CPC ..... *G03G 9/08764* (2013.01); *G03G 9/08704* (2013.01); *G03G 9/08706* (2013.01); *G03G 9/08708* (2013.01); *G03G 9/08711* (2013.01); *G03G 9/08722* (2013.01); *G03G 9/08728* (2013.01); *G03G 9/08753* (2013.01); *G03G 9/08755* (2013.01); *G03G 9/08759* (2013.01); *G03G 9/08795* (2013.01); *G03G 9/08797* (2013.01)

(58) Field of Classification Search
CPC G03G 9/08764; G03G 9/08797; G03G 9/087
USPC ..... 430/109.1, 111.4, 109.31
See application file for complete search history.

(56) References Cited

U.S. PATENT DOCUMENTS

2014/0272698 A1* 9/2014 Yamada et al. ..... 430/109.2

FOREIGN PATENT DOCUMENTS

| | | |
|---|---|---|
| JP | 2004-197051 | 7/2004 |
| JP | 2007-147927 | 6/2007 |
| JP | 2012-27212 | 2/2012 |
| JP | 2012-42939 | 3/2012 |
| JP | 2012-42940 | 3/2012 |
| JP | 2012-42941 | 3/2012 |

* cited by examiner

*Primary Examiner* — Mark A Chapman
(74) *Attorney, Agent, or Firm* — Locke Lord LLP

(57) ABSTRACT

Provided is a toner binder that is excellent in heat resistant storage properties and hot offset resistance properties and also affords excellent anti-blocking properties of paper when printing continuously. The present invention is directed to a toner binder comprising a crystalline resin (A), wherein the crystalline resin (A) comprises two or more crystalline resins (a) and the endothermic peak temperature group that is composed of all of the endothermic peak temperatures of the respective two or more crystalline resins (a) has two or more different endothermic peak temperatures; and a resin particle containing the toner binder.

15 Claims, No Drawings

TONER BINDER AND RESIN PARTICLE

RELATED APPLICATIONS

This application claims priority to Japanese Patent Application No. 2013-052595, filed Mar. 15, 2013, the contents of which are incorporated herein by reference in their entirety.

BACKGROUND OF THE INVENTION (1) Field of the Invention

The present invention relates to a toner binder and a resin particle containing the toner binder.

(2) Description of Related Art

Technologies for fixing a toner with a low energy have heretofore been desired. Accordingly, there is a strong demand for a toner for electrostatic charge development capable of being fixed at a temperature as low as possible.

Since low temperature fixing ability can be secured by lowering the melt viscosity of a toner, a method using a crystalline resin as a toner binder is traditionally known. This method, however, has a problem that hot offset occurs due to shortage of elasticity at the time of melting.

As a measure for solving this problem, there have been disclosed a method of using a crystalline resin and a non-crystalline resin in combination as toner binders (JP-A-2007-147927 and JP-A-2004-197051) and a block polymer of a crystalline polyester and a non-crystalline resin (JP-A-2012-27212, JP-A-2012-42939, JP-A-2012-42940 and JP-A-2012-42941). However, there is a problem that when printing has been performed continuously, printed sheets of paper suffer from blocking (i.e. causing paper to stick together) due to excessively low viscosity of the toner layer fixed to the paper.

SUMMARY OF THE INVENTION

An object of the present invention is to provide a toner binder that is excellent in low temperature fixing ability, heat resistant storage properties and hot offset resistance properties and that also affords excellent anti-blocking properties of paper when printing continuously, and a resin particle containing the toner binder.

In order to solve the problems described above, the present inventors studied intensively and thus have achieved the present invention.

That is, the present invention is directed to a toner binder comprising a crystalline resin (A), wherein the crystalline resin (A) comprises two or more crystalline resins (a) and the endothermic peak temperature (i.e. figures representing the temperature) group that is composed of all of the endothermic peak temperatures of the respective two or more crystalline resins (a) has two or more different endothermic peak temperatures; and a resin particle containing the toner binder.

In one aspect, the invention provides a toner binder comprising a crystalline resin (A), wherein the crystalline resin (A) comprises two or more crystalline resins (a) and the endothermic peak temperature group that is composed of all of the endothermic peak temperatures of the respective two or more crystalline resins (a) has two or more different endothermic peak temperatures.

In certain embodiments, in the endothermic peak temperature group composed of all of the endothermic peak temperatures of the respective two or more crystalline resins (a), the difference between the maximum temperature of the endothermic peaks and the minimum temperature of the endothermic peaks is 3 to 40° C. and the endotherm at the maximum temperature of the endothermic peaks is smaller than the endotherm at the minimum temperature of the endothermic peaks.

In certain embodiments, the endothermic peak temperatures of the respective two or more crystalline resins (a) are 40 to 120° C.

In certain embodiments, in viscoelasticity measurement of the crystalline resin (A), the following condition 1 is satisfied wherein Tup expresses the temperature at which the storage modulus of the crystalline resin (A) becomes $1.0\times10^6$ Pa when the temperature is raised from 30° C. at a rate of 10° C./min and Tdowm expresses the temperature at which the storage modulus of the crystalline resin (A) becomes $1.0\times10^6$ Pa when the temperature is lowered from Tup+20° C. at a rate of 10° C./min.

$$0° C. < Tup - Tdown \leq 30° C. \quad \text{[Condition 1]}$$

In certain embodiments, at least one of the crystalline resins (a) included in the crystalline resin (A) is a resin comprising a crystalline portion (x) and a urethane linkage. In certain embodiments, at least one of the crystalline resins (a) included in the crystalline resin (A) is a resin comprising a crystalline portion (x) and not having a noncrystalline portion (y) (e.g., at least one of the crystalline resins (a) included in the crystalline resin (A) is a resin composed only of a crystalline portion (x)). In certain embodiments, at least one of the crystalline resins (a) included in the crystalline resin (A) is a block polymer resin composed of a crystalline portion (x) and a noncrystalline portion (y). In certain embodiments, the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof. In certain embodiments, the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

In certain embodiments, at least one of the crystalline resins (a) included in the crystalline resin (A) is a resin comprising a crystalline portion (x) and not having a noncrystalline portion (y) (e.g., at least one of the crystalline resins (a) included in the crystalline resin (A) is a resin composed only of a crystalline portion (x)). In certain embodiments, the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

In certain embodiments, at least one of the crystalline resins (a) included in the crystalline resin (A) is a block polymer resin composed of a crystalline portion (x) and a noncrystalline portion (y). In certain embodiments, the content of the crystalline portion (x) is 50 to 99% by weight based on the weight of the (a). In certain embodiments, the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

In certain embodiments, the content of the crystalline resin (A) based on the weight of the toner binder is 51% by weight or more.

In another aspect, the invention provides a resin particle comprising the toner binder according to the invention.

The resin particle of the present invention containing the toner binder of the present invention demonstrates effects of excelling in low temperature fixing ability, a heat resistant storage property, and a hot offset resistance property and affording excellent anti-blocking property of paper when printing continuously.

The resin particle of the present invention is useful as an electrophotography toner, an electrostatic recording toner, an electrostatic printing toner, and the like.

DETAILED DESCRIPTION OF PREFERRED EMBODIMENTS

The crystalline resin (A) in the present invention comprises two or more crystalline resins (a).

The crystalline resin in the present invention means any resin that has a ratio (Tm/Ta) of the softening point (hereinafter abbreviated as Tm) of the resin to the endothermic peak temperature (hereinafter abbreviated as Ta) of from 0.8 to 1.55 and that does not exhibit stepwise endotherm change but have a clear endothermic peak in DSC. Tm and Ta can be measured by the following methods.

<Method for Measuring Tm>

Tm is measured by using a Koka-type flow tester {for example, "CFT-500D" manufactured by Shimadzu Corporation}.

The (a) to be subjected to the measurement of Tm is used in an amount of 1 g as a sample to be measured. A sample to be measured is pushed through a nozzle having a diameter of 1 mm and a length of 1 mm by application of a load of 1.96 MPa by means of a plunger while it is heated at a temperature elevation rate of 6° C./min, and a graph of the "plunger descending amount (flow value)" versus the "temperature" is drawn. The temperature corresponding to ½ of the maximum value of the descending amount of the plunger is read from the graph, and the value (a temperature at which half of the measurement sample has flowed out) is determined as Tm.

<Method for Measuring Ta>

Tm is measured by using a differential scanning calorimeter {for example, "DSC210" manufactured by Seiko Instruments & Electronics Ltd.}.

The (a) to be subjected to the measurement of Ta is, in a pretreatment, melted at 130° C., and allowed to cool from 130° C. to 70° C. at a rate of 1.0° C./min, and allowed to cool from 70° C. to 10° C. at a rate of 0.5° C./min. Herein, endothermic or exothermic change is measured by DSC by elevating the temperature at a temperature elevation rate of 20° C./min, and a graph of the "endothermic or exothermic heat quantity" versus the "temperature" is drawn, and the endothermic peak temperature within the range of 20 to 100° C. observed at this time is determined as Ta'. When there are a plurality of peaks, the temperature of the peak at which the endothermic heat quantity is greatest is determined as Ta'. Subsequently, the sample is stored at (Ta'-10)° C. for 6 hours, and then stored at (Ta'-15)° C. for 6 hours.

Next, after cooling the (a) to 0° C. at a temperature decrease rate of 10° C./min, and the endothermic or exothermic change is measured with DSC by elevating the temperature at a temperature elevation rate of 20° C./min, and a graph is drawn similarly. The temperature that corresponds to the maximum peak of the endotherm is determined as the endothermic peak temperature (Ta) of heat of fusion.

Examples of the crystalline resin (a) in the present invention include crystalline polyester resin (a1), crystalline polyurethane resin (a2), crystalline polyurea resin (a3), crystalline vinyl resin (a4), crystalline epoxy resin (a5), and crystalline polyether resin (a6).

Examples of the crystalline polyester resin (a1) include one composed of a diol (1) and a dicarboxylic acid (2) as constitutional units.

Examples of the diol (1) include alkylene glycols having 2 to 30 carbon atoms (e.g., ethylene glycol, 1,2-propylene glycol, 1,3-propylene glycol, 1,4-butanediol, 1,6-hexanediol, octanediol, decanediol, dodecanediol, tetradecanediol, neopentyl glycol, and 2,2-diethyl-1,3-propanediol); alkylene ether glycols having a number average molecular weight (hereinafter abbreviated as Mn) of 106 to 10,000 (e.g., diethylene glycol, triethylene glycol, dipropylene glycol, polyethylene glycol, polypropylene glycol, and polytetramethylene ether glycol); alicyclic diols having 6 to 24 carbon atoms (for example, 1,4-cyclohexanedimethanol and hydrogenated bisphenol A); alkylene oxide (hereinafter abbreviated as AO) adducts having an Mn of 100 to 10,000 (added mole number of 2 to 100) of the alicyclic diols [for example, ethylene oxide (hereinafter abbreviated as EO) 10 mol adduct of 1,4-cyclohexane dimethanol]; bisphenols having 15 to 30 carbon atoms (bisphenol A, bisphenol F, bisphenol S and the like), or AO [EO, propylene oxide (hereinafter abbreviated as PO), butylene oxide (hereinafter abbreviated as BO) and the like] adducts (added mole number of 2 to 100) of polyphenols having 12 to 24 carbon atoms (for example, catechol, hydroquinone, and resorcinol) (for example, bisphenol A·EO 2 to 4 mol adducts and bisphenol A·PO 2 to 4 mol adduct); polylactonediols having a weight average molecular weight (hereinafter abbreviated as Mw) of 100 to 5,000 (for example, poly-ε-caprolactonediol); polybutadienediols having an Mw of 1,000 to 20,000.

Preferred of these are AO adducts of alkylene glycols and bisphenols, and AO adducts of bisphenols and mixtures of AO adducts of bisphenols and alkylene glycols are more preferred.

Examples of the dicarboxylic acid (2) include alkane dicarboxylic acids having 4 to 32 carbon atoms (e.g., succinic acid, adipic acid, sebacic acid, azelaic acid, dodecanedicarboxylic acid, and octadecanedicarboxylic acid); alkene dicarboxylic acids having 4 to 32 carbon atoms (for example, maleic acid, fumaric acid, citraconic acid, and mesaconic acid); branched alkene dicarboxylic acids having 8 to 40 carbon atoms [for example, dimer acid, alkenylsuccinic acids (dodecenylsuccinic acid, pentadecenylsuccinic acid, octadecenylsuccinic acid, and the like)]; branched alkane dicarboxylic acids having 12 to 40 carbon atoms [for example, alkylsuccinic acids (decylsuccinic acid, dodecylsuccinic acid, octadecylsuccinic acid, and the like)]; and aromatic dicarboxylic acids having 8 to 20 carbon atoms (for example, phthalic acid, isophthalic acid, terephthalic acid, naphthalene dicarboxylic acid, and the like).

Preferred of these are alkene dicarboxylic acids and aromatic dicarboxylic acids, and aromatic dicarboxylic acids are more preferred.

(a1) is preferably one in which the constitutional units of the diol (1) and the carboxylic acid (2) in total have 10 or more, more preferably 12 or more, particularly preferably 14 or more carbon atoms from the viewpoint of heat resistant storage stability; whereas from the viewpoint of the low temperature fixing ability of a toner, (a1) is preferably one in which said two constitutional units (i.e. the diol (1) and the carboxylic acid (2)) in total have 52 or less, more preferably 45 or less, particularly preferably 40 or less, most preferably 30 or less carbon atoms.

Examples of the crystalline polyurethane resin (a2) include one (a2-1) that comprises said diol (1) and/or a diamine (3) and a diisocyanate (4) as constitutional units, and one (a2-2)

that comprises said crystalline polyester resin (a1) as well as said diol (1) and/or a diamine (3) and also a diisocyanate (4) as constitutional units.

Examples of the diamine (3) include aliphatic diamines having 2 to 18 carbon atoms and aromatic diamine having 6 to 20 carbon atoms.

Examples of the aliphatic diamines having 2 to 18 carbon atoms include linear aliphatic diamines and cyclic aliphatic diamines.

Examples of the linear aliphatic diamines include alkylene diamines having 2 to 12 carbon atoms (ethylenediamine, propylenediamine, trimethylenediamine, tetramethylene diamine, hexamethylenediamine, and the like), and polyalkylene (having 2 to 6 carbon atoms) polyamines [diethylenetriamine, iminobispropylamine, bis(hexamethylene)triamine, triethylenetetramine, tetraethylenepentamine, pentaethylenehexamine, and the like].

Examples of the cyclic aliphatic polyamines include alicyclic diamines having 4 to 15 carbon atoms {1,3-diaminocyclohexane, isophoronediamine, menthenediamine, 4,4'-methylenedicyclohexanediamine(hydrogenated methylenedianiline), 3,9-bis(3-aminopropyl)-2,4,8,10-tetraoxaspiro[5,5]undecane, and the like}, and heterocyclic diamines having 4 to 15-carbon atoms [piperazine, N-aminoethylpiperazine, 1,4-diaminoethylpiperazine, 1,4-bis(2-amino-2-methylpropyl)piperazine, and the like].

Examples of the aromatic diamines having 6 to 20 carbon atoms include non-substituted aromatic diamines and aromatic diamines having an alkyl group (an alkyl group having 1 to 4 carbon atoms, such as a methyl group, an ethyl group, a n- or isopropyl group, and a butyl group).

Examples of the non-substituted aromatic diamines include 1,2-, 1,3-, or 1,4-phenylenediamine, 2,4'- or 4,4'-diphenylmethanediamine, diaminodiphenylsulfone, benzidine, thiodianiline, bis(3,4-diaminophenyl)sulfone, 2,6-diaminopyridine, m-aminobenzylamine, naphthylenediamine, and mixtures thereof.

Examples of the aromatic diamine having an alkyl group (an alkyl group having 1 to 4 carbon atoms, such as a methyl group, an ethyl group, a n- or isopropyl group, and a butyl group) include 2,4- or 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-diethyl-2,4-diaminobenzene, 1,3-dimethyl-2,6-diaminobenzene, 1,4-diethyl-2,5-diaminobenzene, 1,4-diisopropyl-2,5-diaminobenzene, 1,4-dibutyl-2,5-diaminobenzene, 2,4-diaminomesitylene, 1,3,5-triethyl-2,4-diaminobenzene, 1,3,5-triisopropyl-2,4-diaminobenzene, 1-methyl-3,5-diethyl-2,4-diaminobenzene, 1-methyl-3,5-diethyl-2,6-diaminobenzene, 2,3-dimethyl-1,4-diaminonaphthalene, 2,6-dimethyl-1,5-diaminonaphthalene, 2,6-diisopropyl-1,5-diaminonaphthalene, 2,6-dibutyl-1,5-diaminonaphthalene, 3,3',5,5'-tetramethylbenzidine, 3,3',5,5'-tetraisopropylbenzidine, 3,3',5,5'-tetramethyl-4,4'-diaminodiphenylmethane, 3,3',5,5'-tetraethyl-4,4'-diaminodiphenylmethane, 3,3',5,5'-tetraisopropyl-4,4'-diaminodiphenylmethane, 3,3',5,5'-tetrabutyl-4,4'-diaminodiphenylmethane, 3,5-diethyl-3'-methyl-2',4-diaminodiphenylmethane, 3,5-diisopropyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraisopropyl-4,4'-diaminobenzophenone, 3,3',5,5'-tetraethyl-4,4'-diaminodiphenylether, 3,3',5,5'-tetraisopropyl-4,4'-diaminodiphenylsulfone, and mixtures thereof.

Examples of the diisocyanate (4) include aromatic diisocyanates having 6 to 20 carbon atoms (excluding the carbon atoms in the NCO groups; the same applies hereinafter), aliphatic diisocyanates having 2 to 18 carbon atoms, modified products of these diisocyanates (e.g., urethane group-, carbodiimide group-, allophanate group-, urea group-, biuret group-, uretdione group-, urethoimine group-, isocyanurate group-, and oxazolidone group-containing modified products), and mixtures of two or more of these.

Examples of the aromatic diisocyanates include 1,3- or 1,4-phenylene diisocyanate, 2,4- or 2,6-tolylene diisocyanate (TDI), crude TDI, m- or p-xylylene diisocyanate (XDI), α,α,α',α'-tetramethylxylylene diisocyanate (TMXDI), 2,4'- or 4,4'-diphenylmethane diisocyanate (MDI), crude MDI {crude diaminophenylmethane [a condensate made up of formamide and an aromatic amine(aniline) or a mixture of aromatic amines, and mixtures thereof.

Examples of the aliphatic diisocyanates include linear aliphatic diisocyanates and cyclic aliphatic diisocyanates.

Examples of the linear aliphatic diisocyanates include ethylene diisocyanate, tetramethylene diisocyanate, hexamethylene diisocyanate (HDI), dodecamethylene diisocyanate, 2,2,4-trimethylhexamethylene diisocyanate, lysine diisocyanate, 2,6-diisocyanato methylcaproate, bis(2-isocyanatoethyl)fumarate, bis(2-isocyanatoethyl) carbonate, 2-isocyanatoethyl-2,6-diisocyanato hexanoate, and mixtures thereof.

Examples of the cyclic aliphatic diisocyanates include isophorone diisocyanate (IPDI), dicyclohexymethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- or 2,6-norbornane diisocyanate, and mixtures thereof.

Examples of modified products of diisocyanates to be used include modified products containing a urethane group, a carbodiimide group, an allophanate group, a urea group, a biuret group, a uretdione group, a uretoimine group, an isocyanurate group and/or an oxazolidone group, and specific examples thereof include modified MDI (e.g., urethane-modified MDI, carbodiimide-modified MDI, and trihydrocarbyl phosphate-modified MDI), urethane-modified TDI, and mixtures thereof [e.g., a mixture of a modified MDI and a urethane-modified TDI (an isocyanate-containing prepolymer)].

Preferred of the diisocyanates (4) are aromatic diisocyanates having 6 to 15 carbon atoms and aliphatic diisocyanates having 4 to 15 carbon atoms, and TDI, MDI, HDI, hydrogenated MDI, and IPDI are more preferred.

The crystalline polyurethane resin (a2) may include a diol (1') having at least one group selected from the group consisting of a carboxylic acid (salt) group, a sulfonic acid (salt) group, a sulfamic acid (salt) group, and a phosphoric acid (salt) group as a constitutional unit in addition to the diol (1). The inclusion of the diol (1') as a constitutional unit in the (a2) improves the electrostatic property and the heat resistant storage stability of a resin particle.

The term "acid (salt)" as used in the present specification means an acid or an acid salt.

Examples of the diol (1') having a carboxylic acid (salt) group include tartaric acid (salt), 2,2-bis(hydroxymethyl) propanoic acid (salt), 2,2-bis(hydroxymethyl)butanoic acid (salt) and 3-[bis(2-hydroxyethyl)amino]propanoic acid (salt).

Examples of the diol (1') having a sulfonic acid (salt) group include 2,2-bis(hydroxymethyl)ethanesulfonic acid (salt), 2-[bis(2-hydroxyethyl)amino]ethanesulfonic acid (salt), and 5-sulfo-isophthalic acid-1,3-bis(2-hydroxyethyl) ester (salt).

Examples of the diol (1') having a sulfamic acid (salt) group include N,N-bis(2-hydroxyethyl)sulfamic acid (salt), N,N-bis(3-hydroxypropyl)sulfamic acid (salt), N,N-bis(4-hydroxybutyl)sulfamic acid (salt), and N,N-bis(2-hydroxypropyl)sulfamic acid (salt).

Examples of the diol (1') having a phosphoric acid (salt) group include bis(2-hydroxyethyl)phosphate (salt).

Examples of the salt that constitutes an acid salt include ammonium salt, amine salts (methylamine salt, dimethylamine salt, trimethylamine salt, ethylamine salt, diethylamine salt, triethylamine salt, propylamine salt, dipropylamine salt, tripropylamine salt, butylamine salt, dibutyl amine salt, tributylamine salt, monoethanolamine salt, diethanolamine salt, triethanolamine salt, N-methylethanolamine salt, N-ethylethanolamine salt, N,N-dimethylethanolamine salt, N,N-diethylethanolamine salt, hydroxylamine salt, N,N-diethylhydroxylamine salt, morpholine salt, and the like), quaternary ammonium salts [tetramethylammonium salt, tetraethylammonium salt, trimethyl(2-hydroxyethyl) ammonium salt, and the like], and alkali metal salts (sodium salt, potassium salt, and the like).

Preferred of the diols (1') from the viewpoint of the electrostatic property and the heat resistant storage stability of a resin particle are the diol (1') having a carboxylic acid (salt) group and the diol (1') having a sulfonic acid (salt) group.

Examples of the crystalline polyurea resin (a3) include ones comprising the above-described diamine (3) and the above-described diisocyanate (4) as constitutional units.

Examples of the crystalline vinyl resin (a4) include polymers prepared by homopolymerizing or copolymerizing a monomer or monomers having a polymerizable double bond (i.e. having at least one polymerizable double bond.). Examples of the monomer having a polymerizable double bond include the following (5) through (13).

(5) Hydrocarbon having a polymerizable double bond:

(5-1) Aliphatic hydrocarbon having a polymerizable double bond:

(5-1-1) Linear hydrocarbon having a polymerizable double bond: alkenes having 2 to 30 carbon atoms (e.g., ethylene, propylene, butene, isobutylene, pentene, heptene, diisobutylene, octene, dodecene, and octadecene); and alkadienes having 4 to 30 carbon atoms (e.g., butadiene, isoprene, 1,4-pentadiene, 1,5-hexadiene, and 1,7-octadiene).

(5-1-2) Cyclic hydrocarbon having a polymerizable double bond: mono- or dicycloalkenes having 6 to 30 carbon atoms (e.g., cyclohexene, vinylcyclohexene, and ethylidenebicycloheptene), mono- or dicycloalkadienes having 5 to 30 carbon atoms [e.g., (di)cyclopentadiene], etc.

(5-2) Aromatic hydrocarbons having a polymerizable double bond: styrene; hydrocarbyl(alkyl, cycloalkyl, aralkyl, and/or alkenyl having 1 to 30 carbon atoms)-substituted styrenes (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene); vinylnaphthalene, etc.

(6) Monomers having a carboxyl group and a polymerizable double bond, and their salts:

Unsaturated monocarboxylic acids having 3 to 15 carbon atoms {e.g., (meth)acrylic acid ["(meth)acrylic" means acrylic or methacrylic] crotonic acid, isocrotonic acid, and cinnamic acid}; unsaturated dicarboxylic acids (anhydrides) ["acids (anhydrides)" means acids or anhydrides] having 3 to 30 carbon atoms [e.g., maleic acid (anhydride), fumaric acid, itaconic acid, citraconic acid (anhydride), and mesaconic acid]; and monoalkyl (having 1 to 10 carbon atoms) esters of unsaturated dicarboxylic acids having 3 to 10 carbon atoms (e.g., monomethyl maleate, monodecyl maleate, monoethyl fumarate, monobutyl itaconate, and monodecyl citraconate), etc.

Examples of the salts that constitute the salts of monomers having a carboxyl group and a polymerizable double bond include alkali metal salts (sodium salts, potassium salts, and the like), alkaline earth metal salts (calcium salts, magnesium salts, and the like), ammonium salts, amine salts, and quaternary ammonium salts.

The amine salts are not particularly restricted as long as they are amine compounds and examples thereof include primary amine salts (ethylamine salts, butylamine salts, octylamine salts, and the like), secondary amines (diethylamine salts, dibutylamine salts, and the like), tertiary amines (triethylamine salts, tributylamine salts, and the like).

Examples of the quaternary ammonium salts include tetraethylammonium salts, triethyllaurylammonium salts, tetrabutylammonium salts, and tributyllaurylammonium salts.

Examples of the salts of monomers having a carboxyl group and a polymerizable double bond include sodium acrylate, sodium methacrylate, monosodium maleic acid, disodium maleate, potassium acrylate, potassium methacrylate, monopotassium maleate, lithium acrylate, cesium acrylate, ammonium acrylate, calcium acrylate, and aluminum acrylate.

(7) Monomers having a sulfo group and a polymerizable double bond, and their salts:

Alkene sulfonic acids having 2 to 14 carbon atoms (e.g., vinylsulfonic acid, (meth)allylsulfonic acid, and methylvinylsulfonic acid); styrenesulfonic acid and alkyl (having 2 to 24 carbon atom) derivatives thereof (e.g., α-methylstyrenesulfonic acid; sulfo(hydroxy)alkyl(meth)acrylate having 5 to 18 carbon atoms (e.g., sulfopropyl(meth)acrylate, 2-hydroxy-3-(meth)acryloxypropyl sulfonate, 2-(meth)acryloyloxy ethanesulfonate, and 3-(meth)acryloyloxy-2-hydroxypropanesulfonic acid); sulfo(hydroxy)alkyl (meth) acrylamides having 5 to 18 carbon atoms [e.g., 2-(meth) acryloylamino-2,2-dimethylethanesulfonic acid, 2-(meth) acrylamide-2-methylpropanesulfonic acid, and 3-(meth) acrylamide-2-hydroxypropanesulfonic acid]; alkyl(having 3 to 18 carbon atoms)allylsulfosuccinic acids (e.g., propylallylsulfosuccinic acid, butylallylsulfosuccinic acid, and 2-ethylhexylallylsulfosuccinic acid); sulfuric acid esters of poly [n (degree of polymerization; the same applies hereinafter)=2 to 30]oxyalkylene (e.g., oxyethylene, oxypropylene, and oxybutylene; oxyalkylenes may be used either alone or in combination, and when used in combination, the addition mode may be either random addition or block addition) mono (meth)acrylates [e.g., poly(n=5 to 15)oxyethylene mono (meth)acrylate sulfate and poly(n=5 to 15)oxypropylene mono(meth)acrylate sulfate]; compounds represented by the following formulae (1) to (3); and salts thereof.

Examples of the salts include those salts that form [(6) the salts of the monomers having a carboxyl group and a polymerizable double bond].

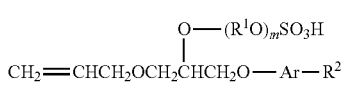

(1)

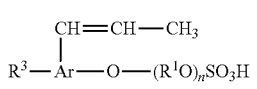

(2)

-continued $$HOSO_2CH(CH_2COOR^4)COOCH_2CH(OH)CH_2OCH_2CH{=}CH_2 \quad (3)$$

In the formulae, $R^1$ is an alkylene group having 2 to 4 carbon atoms; when there are a plurality of $R^1$Os, they may be either of a single kind or of two or more kinds, and when two or more kinds of $R^1$Os are used in combination, the bonding mode may be either random or block; $R^2$ and $R^3$ each independently represent an alkyl group having 1 to 15 carbon atoms; m and n each independently represent an integer of 1 to 50; Ar represents a benzene ring; and $R^4$ represents an alkyl group having 1 to 15 carbon atoms optionally substituted with a fluorine atom.

(8) Monomers having a phosphono group and a polymerizable double bond, and their salts:

(Meth)acryloyloxyalkyl monophosphates (the alkyl group has 1 to 24 carbon atoms) (e.g., 2-hydroxyethyl(meth)acryloyl phosphate and phenyl-2-acryloyloxyethyl phosphate), and (meth)acryloyloxyalkyl phosphonates (the alkyl group has 1 to 24 carbon atoms) (e.g., 2-acryloyloxyethyl phosphonic acid).

Examples of the salts include those salts that form [(6) the monomers having a carboxyl group and a polymerizable double bond].

(9) Monomers having a hydroxyl group and a polymerizable double bond:

Hydroxystyrene, N-methylol(meth)acrylamide, hydroxyethyl (meth)acrylate, hydroxypropyl (meth)acrylate, polyethylene glycol mono(meth)acrylate, (meth)allyl alcohol, crotyl alcohol, isocrotyl alcohol, 1-buten-3-ol, 2-buten-1-ol, 2-butene-1,4-diol, propargyl alcohol, 2-hydroxyethyl propenyl ether, sucrose allyl ether, and the like.

(10) Nitrogen-containing monomers having a polymerizable double bond:

(10-1) Monomers having an amino group and a polymerizable double bond:

Aminoethyl (meth)acrylate, dimethylaminoethyl (meth) acrylate, diethylaminoethyl (meth)acrylate, tert-butylaminoethyl methacrylate, N-aminoethyl (meth)acrylamide, (meth) allylamine, morpholinoethyl (meth)acrylate, 4-vinylpyridine, 2-vinylpyridine, crotylamine, N,N-dimethylaminostyrene, methyl-α-acetaminoacrylate, vinylimidazole, N-vinylpyrrole, N-vinylthiopyrrolidone, N-arylphenylenediamine, aminocarbazole, aminothiazole, aminoindole, aminopyrrole, aminoimidazole, aminomercaptothiazole, salts thereof, and so on.

(10-2) Monomers having an amide group and a polymerizable double bond:

(Meth)acrylamide, N-methyl(meth)acrylamide, N-butylacrylamide, diacetone acrylamide, N-methylol(meth)acrylamide, N,N'-methylene-bis(meth)acrylamide, cinnamide, N,N-dimethylacrylamide, N,N-dibenzylacrylamide, methacrylformamide, N-methyl-N-vinylacetamide, N-vinylpyrrolidone, and the like.

(10-3) Monomers having 3 to 10 carbon atoms and having a nitrile group and a polymerizable double bond:

(Meth)acrylonitrile, cyanostyrene, cyanoacrylate, and the like.

(10-4) Monomers having 8 to 12 carbon atoms and having a nitro group and a polymerizable double bond:

Nitrostyrene, and the like.

(11) Monomers having 6 to 18 carbon atoms and having an epoxy group and a polymerizable double bond:

Glycidyl (meth)acrylate, p-vinylphenylphenyl oxide, and the like.

(12) Monomers having 2 to 16 carbon atoms and having a halogen element and a polymerizable double bond:

Vinyl chloride, vinyl bromide, vinylidene chloride, allyl chloride, chlorostyrene, bromostyrene, dichlorostyrene, chloromethylstyrene, tetrafluorostyrene, chloroprene, and the like.

(13) Esters having a polymerizable double bond, ethers having a polymerizable double bond, ketones having a polymerizable double bond, and sulfur-containing compounds having a polymerizable double bond:

(13-1) Esters having 4 to 16 carbon atoms and having a polymerizable double bond:

Vinyl acetate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxyacetate, vinyl benzoate, ethyl α-ethoxyacrylate, alkyl (meth) acrylates having an alkyl group having 1 to 50 carbon atoms [methyl (meth)acrylate, ethyl (meth)acrylate, propyl (meth) acrylate, butyl (meth)acrylate, 2-ethylhexyl (meth)acrylate, dodecyl (meth)acrylate, hexadecyl (meth)acrylate, heptadecyl (meth)acrylate, eicosyl (meth)acrylate, and the like], dialkyl fumarates (the two alkyl groups are linear, branched, or alicyclic groups having 2 to 8 carbon atoms), dialkyl maleates (the two alkyl groups are linear, branched, or alicyclic groups having 2 to 8 carbon atoms), poly(meth)allyloxyalkanes (diallyloxyethane, triallyloxyethane, tetraallyloxyethane, tetraallyloxypropane, tetraallyloxybutane, tetramethallyloxyethane, and the like), monomers having a polyalkylene glycol chain and a polymerizable double bond [polyethylene glycol [Mn=300] mono(meth)acrylate, polypropylene glycol (Mn=500) monoacrylate, methanol 10 mol EO adduct (meth)acrylate, lauryl alcohol 30 mol EO adduct (meth)acrylate, and the like], and poly(meth)acrylates [poly(meth)acrylates of polyhydric alcohols: ethylene glycol di(meth)acrylate, propylene glycol di(meth)acrylate, neopentyl glycol di(meth)acrylate, trimethylolpropane tri(meth) acrylate, polyethylene glycol di(meth)acrylate, and the like] are provided as examples.

(13-2) Ethers having 3 to 16 carbon atoms and having a polymerizable double bond:

Vinyl methyl ether, vinyl ethyl ether, vinyl propyl ether, vinyl butyl ether, vinyl 2-ethyl hexyl ether, vinyl phenyl ether, vinyl 2-methoxyethyl ether, methoxybutadiene, vinyl 2-butoxyethyl ether, 3,4-dihydro-1,2-pyrane, 2-butoxy-2'-vinyloxydiethyl ether, acetoxystyrene, phenoxystyrene are provided as examples.

(13-3) Ketones having 4 to 12 carbon atoms and having a polymerizable double bond:

Vinyl methyl ketone, vinyl ethyl ketone, and vinyl phenyl ketone are provided as examples.

(13-4) Sulfur-containing compounds having 2 to 16 carbon atoms and having a polymerizable double bond:

Divinyl sulfide, p-vinyldiphenyl sulfide, vinylethyl sulfide, vinyl ethyl sulfone, divinyl sulfone, and divinyl sulfoxide are provided as examples.

Examples of the crystalline epoxy resin (a5) include ring opening polymers of polyepoxide (14) and polyadducts of polyepoxide (14) with an active hydrogen-containing compound [water, the above-described diol (1), the above-described dicarboxylic acid (2), the above-described diamine (3), and the like].

The polyepoxide (14) is not particularly restricted as long as it has two or more epoxy groups in its molecule. From the viewpoint of mechanical properties of a cured product, ones having 2 to 6 epoxy groups in a molecule are preferred among polyepoxides (14). The epoxy equivalent (the molecular weight per epoxy group) of the polyepoxide (14) is preferably 65 to 1,000, more preferably 90 to 500. If the epoxy equivalent is 1,000 or less, a crosslinked structure becomes denser, so that physical properties, such as water resistance, chemical resistance, and mechanical strength, of a cured product are improve, whereas it is difficult to synthesize ones having an epoxy equivalent of less than 65.

Examples of the polyepoxide (14) include aromatic polyepoxy compounds, heterocyclic polyepoxy compounds, alicyclic polyepoxy compounds, and aliphatic polyepoxy compounds.

Examples of the aromatic polyepoxy compounds include glycidyl ethers and glycidyl esters of polyhydric phenols, glycidyl aromatic polyamines, and glycidylated products of aminophenol.

Examples of the glycidyl ethers of polyhydric phenols include bisphenol F diglycidyl ether, bisphenol A diglycidyl ether, bisphenol B diglycidyl ether, bisphenol AD diglycidyl ether, bisphenol S diglycidyl ether, halogenated bisphenol A diglycidyl ether, tetrachlorobisphenol A diglycidyl ether, catechin diglycidyl ether, resorcinol diglycidyl ether, hydroquinone diglycidyl ether, pyrogallol triglycidyl ether, 1,5-dihydroxynaphthalene diglycidyl ether, dihydroxybiphenyl diglycidyl ether, octachloro-4,4'-dihydroxybiphenyl diglycidyl ether, tetramethylbiphenyl diglycidyl ether, dihydroxynaphthylcresol triglycidyl ether, tris(hydroxyphenyl)methane triglycidyl ether, dinaphthyltriol triglycidyl ether, tetrakis (4-hydroxyphenyl)ethane tetraglycidyl ether, p-glycidylphenyl dimethyl triol bisphenol A glycidyl ether, trismethyl-tert-butyl-butylhydroxymethane triglycidyl ether, 9,9'-bis(4-hydroxyphenyl)fluorene diglycidyl ether, 4,4'-oxybis(1,4-phenylethyl)tetracresol glycidyl ether, 4,4'-oxybis(1,4-phenylethyl)phenyl glycidyl ether, bis(dihydroxynaphthalene)tetraglycidyl ether, phenol or cresol novolak resin glycidyl ether, limonene phenol novolak resin glycidyl ether, diglycidyl ethers obtained by reaction between 2 moles of bisphenol A and 3 moles of epichlorohydrin, polyphenol polyglycidyl ethers obtained by condensation reaction of phenol with glyoxal, glutaraldehyde or formaldehyde, and polyphenol polyglycidyl ethers obtained by condensation reaction of resorcin with acetone.

Examples of the glycidyl esters of polyhydric phenols include phthalic acid diglycidyl ester, isophthalic acid diglycidyl ester, and terephthalic acid diglycidyl ester.

Examples of the glycidyl aromatic polyamines include N,N-diglycidylaniline, N,N,N',N'-tetraglycidyl xylylene diamine and N,N,N',N'-tetraglycidyldiphenylmethane diamine. Examples of the aromatic polyepoxy compounds also include triglycidyl ether of p-aminophenol, diglycidyl urethane compounds obtained by addition reaction of tolylene diisocyanate or diphenylmethane diisocyanate with glycidol, glycidyl group-containing polyurethane (pre)polymers) polymers obtained by causing polyols to react in addition to the preceding two reactants, and diglycidyl ethers of AO adducts of bisphenol A.

Examples of the heterocyclic polyepoxy compounds include trisglycidyl melamine.

Examples of the alicyclic polyepoxy compounds include vinylcyclohexane dioxide, limonene dioxide, dicyclopentadiene dioxide, bis(2,3-epoxycyclopentyl)ether, ethylene glycol bisepoxydicyclopentyl ether, 3,4-epoxy-6-methylcyclohexylmethyl-3',4'-epoxy-6'-methylcyclohexane carboxylate, bis(3,4-epoxy-6-methylcyclohexylmethyl)adipate, bis(3,4-epoxy-6-methylcyclohexylmethyl)butylamine, and dimeric acid diglycidyl ester. Examples of the alicyclics further include nuclear-hydrogenated forms of the above-described aromatic polyepoxy compounds.

Examples of the aliphatic polyepoxy compounds include polyglycidyl ethers of polyhydric aliphatic alcohols, polyglycidyl esters of polyhydric fatty acids, and glycidyl aliphatic amines. Examples of the polyglycidyl ethers of polyhydric aliphatic alcohols include ethylene glycol diglycidyl ether, propylene glycol diglycidyl ether, tetramethylene glycol diglycidyl ether, 1,6-hexanediol diglycidyl ether, polyethylene glycol diglycidyl ether, polypropylene glycol diglycidyl ether, polytetramethylene glycol diglycidyl ether, neopentyl glycol diglycidyl ether, trimethylolpropane polyglycidyl ether, glycerol polyglycidyl ether, pentaerythritol polyglycidyl ether, sorbitol polyglycidyl ether, and polyglycerol polyglycidyl ether. Examples of the polyglycidyl esters of polyhydric fatty acids include diglycidyl oxalate, diglycidyl malate, diglycidyl succinate, diglycidyl glutarate, diglycidyl adipate, and diglycidyl pimelate. Examples of the glycidyl aliphatic amines include N,N,N',N'-tetraglycidylhexamethylenediamine. Examples of the aliphatics also include (co) polymers of diglycidyl ethers and glycidyl (meth)acrylate.

Preferred of the polyepoxides (14) are aliphatic polyepoxy compounds and aromatic polyepoxy compounds. Polyepoxides may be uses in a combination of two or more.

Examples of the crystalline polyether resin (a6) include crystalline polyoxyalkylene polyols.

The method for producing the crystalline polyoxyalkylene polyols is not particularly limited and any conventionally known method may be used.

Examples thereof include a method of ring-opening polymerizing a chiral polyoxyalkylene polyol with a catalyst to be used for ordinary polymerization of polyoxyalkylene polyol (disclosed in, for example, Journal of the American Chemical Society, 1956, Vol. 78, No. 18, p. 4787-4792), and a method of ring-opening polymerizing inexpensive racemic polyoxyalkylene polyol by using a complex having a sterically bulky special chemical structure as a catalyst.

Examples of the method using such a special complex include a method using a compound prepared by bringing a lanthanoid complex and organic aluminum into contact with each other as a catalyst (disclosed in JP-A-11-12353) and a method of causing bimetal-μ-oxoalkoxide to react with a hydroxyl compound beforehand (disclosed in JP-T-2001-521957).

Examples of a method for obtaining a polyoxyalkylene polyol having very high isotacticity include a method using a salen complex as a catalyst (disclosed in Journal of the American Chemical Society, 2005, Vol. 127, No. 33, p. 11566-11567).

For example, when a chiral polyoxyalkylene polyol is used and a glycol or water is used as an initiator at the time of ring-opening polymerization thereof, a polyoxyalkylene glycol having a hydroxyl group at its terminal and having an isotacticity of 50% or more is obtained. A polyoxyalkylene glycol having an isotacticity of 50% or more may be one having been modified at its terminal so as to become, for example, a carboxyl group. If the isotacticity is 50% or more, the polyoxyalkylene polyol usually has crystallinity.

Examples of the above-mentioned glycol include the above-described diol (1), and examples of the carboxylic acid to be used for carboxy modification include the above-described dicarboxylic acid (2).

Examples of a raw material to be used for the production of the crystalline polyoxyalkylene polyol include PO, 1-chlorooxetane, 2-chlorooxetane, 1,2-dichlorooxetane, epichlorohydrin, epibromohydrin, BO, methylglycidyl ether, 1,2-pentylene oxide, 2,3-pentylene oxide, 3-methyl-1,2-butylene oxide, cyclohexene oxide, 1,2-hexylene oxide, 3-methyl-1,2-pentylene oxide, 2,3-hexylene oxide, 4-methyl-2,3-pentylene oxide, allyl glycidyl ether, 1,2-heptylene oxide, styrene oxide, and phenyl glycidyl ether. These raw materials may be used singly or in a combination of two or more. Preferred of these are PO, BO, styrene oxide, and cyclohexene oxide.

Preferred of the crystalline resins (a) from the viewpoint of the adhesion strength of a toner are a crystalline polyester resin (a1) and a crystalline polyurethane resin (a2), more preferred is the (a2), particularly preferred is (a2-2), and most preferred of the (a2-2) is one having an ester group and a urethane group in the molecule.

The crystalline resin (A) referred to in the present invention comprises two or more crystalline resins (a) and the endothermic peak temperature group that is composed of all of the endothermic peak temperatures of the respective two or more crystalline resins (a) has two or more different endothermic peak temperatures (Ta).

For examples, when the crystalline resin (A-1) comprises five kinds of crystalline resins (a-1) through (a-5), the crystalline resin (A-2) comprises five kinds of crystalline resins (a-6) through (a-10), and their respective (Ta) are as follows, then the (A-1) and the (A-2) each comprise two or more crystalline resins (a) and the endothermic peak temperature group that is composed of all of the endothermic peak temperatures of the respective two or more crystalline resins (a) has two or more different endothermic peak temperatures (Ta).

Endothermic peak temperature (figures) group of crystalline resin (A-1)

(a-1): (Ta)=50° C.
(a-2): (Ta)=50° C.
(a-3): (Ta)=50° C.
(a-4): (Ta)=50° C.
(a-5): (Ta)=52° C.

Endothermic peak temperature (number) group of crystalline resin (A-2)

(a-6): (Ta)=53° C.
(a-7): (Ta)=60° C.
(a-8): (Ta)=58° C.
(a-9): (Ta)=71° C.
(a-10): (Ta)=84° C.

On the other hand, when the crystalline resin (A'-1) comprises five kinds of crystalline resins (a-11) through (a-15) and their (Ta) are as follows, then the (A'-1) comprises two or more crystalline resins (a), but the endothermic peak temperature group that is composed of all of the endothermic peak temperatures of the respective two or more crystalline resins (a) does not have two or more different endothermic peak temperatures (Ta).

Endothermic peak temperature (number) group of crystalline resin (A'-1)

(a-11): (Ta)=62° C.
(a-12): (Ta)=62° C.
(a-13): (Ta)=62° C.
(a-14): (Ta)=62° C.
(a-15): (Ta)=62° C.

From the viewpoints of low temperature fixing ability and heat resistant storage stability, the respective endothermic peak temperatures of the two or more crystalline resins (a) are preferably 40 to 120° C., more preferably 45 to 100° C., and particularly preferably 50 to 90° C.

In the endothermic peak temperature group that is composed of all of the endothermic peak temperatures of the respective two or more crystalline resins (a) included in a crystalline resin (A), the difference between the maximum temperature of the endothermic peaks [hereinafter abbreviated as (TaMAX)] and the minimum temperature of the endothermic peaks [hereinafter abbreviated as (TaMIN)] is preferably 3 to 40° C., more preferably 5 to 35° C., and particularly preferably 7 to 30° C. from the viewpoints of hot offset resistance properties and low temperature fixing ability.

Preferably, the endotherm at (TaMAX) of the two or more crystalline resins (a) is smaller than the endotherm at (TaMIN). The endotherm of (a) at (TaMAX) and (TaMIN) can be measured by the same method as the method for measuring the above-described (Ta).

The crystalline resin (A) in the present invention preferably satisfies the following [condition 1] in viscoelasticity measurement of the (A), wherein Tup expreses the temperature at which the storage modulus of the (A) becomes $1.0\times10^6$ Pa when the temperature is raised from 30° C. at a rate of 10° C./min and Tdown expresses the temperature at which the storage modulus of the (A) becomes $1.0\times10^6$ Pa when the temperature is lowered from (Tup)+20° C. at a rate of 10° C./min. Satisfaction by the (A) of the following [condition 1] affords improved hot offset resistance properties.

$$0° C. < Tup - Tdown \leq 30° C. \quad \text{[Condition 1]}$$

In the present invention, the viscoelasticity of the crystalline resin (A) can be measured a frequency of 1 Hz by using a dynamic viscoelasticity analyzer "RDS-2" [manufactured by Rheometric Scientific].

In the viscoelasticity measurement of the (A), after the (A) is set in a jig of the measuring apparatus, the temperature is raised to (Ta+30)° C. to make the sample be adhered firmly to the jig, and then the temperature is decreased from (Ta+30)° C. to (Ta−30)° C. at a rate of 0.5° C./min, followed by leaving at rest at (Ta−30)° C. for 1 hour, and then the temperature is raised to (Ta−10)° C. at a rate of 0.5° C./min, followed by leaving at rest at (Ta−10)° C. for 1 hour to make crystallization sufficiently proceed, and subsequently Tup and Tdown of the (A) are measured using the resultant sample.

The crystalline resin (a) in the present invention may be a resin that is selected from the crystalline polyester resin (a1), the crystalline polyurethane resin (a2), the crystalline polyurea resin (a3), the crystalline vinyl resin (a4), the crystalline epoxy resin (a5), the crystalline polyether resin (a6), which were all provided as examples of the above-described (a), and their composite resins, and that is constituted only of a crystalline portion (x), or alternatively may be a block resin comprising one or more crystalline portions (x) and one or more noncrystalline portions (y) made of a noncrystalline resin (b).

Examples of the noncrystalline resin (b) in the present invention include a resin that is of the same composition as the crystalline polyester resin (a1), the crystalline polyurethane resin (a2), the crystalline polyurea resin (a3), the crystalline vinyl resin (a4), the crystalline epoxy resin (a5), the crystalline polyether resin (a6), which were all provided as examples of the above-described (a), and that has a ratio of Tm to Ta (That is Tm/Ta) of greater than 1.55.

When the crystalline resin (a) is a block resin composed of a crystalline part (x) and a noncrystalline part (y), whether a binder is used or not is selected in consideration of the reactivity of the respective terminal functional groups of the (x) and the (y), and when a binder is used, the type of the binder suited for the terminal functional groups is selected, and the block resin can be formed by bonding the (x) with the (y).

When a binder is not used, a reaction between a terminal functional group of (a) that forms (x) and a terminal functional group of (b) that forms (y) is caused to proceed while, as necessary, heating and reducing pressure. In particular, in the case of a reaction between an acid and an alcohol or a reaction between an acid and an amine, the reaction proceeds smoothly when one of the resins has a high acid value and the other resin has a high hydroxyl value or a high amine value. Preferably, the reaction is performed at a temperature of 180° C. to 230° C.

When a binder is used, a variety of binders can be used. Examples of the binder include the diol (1), the dicarboxylic acid (2), the diamine (3), the diisocyanate (4), which were described above, and a polyepoxide.

Examples of the method for binding the (x) and the (y) include dehydration reaction and addition reaction of the (x) and the (y).

Examples of the dehydration reaction include a reaction wherein both the (x) and the (y) have a hydroxy group and these are combined with a binder [for example, the dicarboxylic acid (2)]. The dehydration reaction can be performed at a reaction temperature of 180 to 230° C. in the absence of any solvent.

Examples of the addition reaction include a reaction wherein both the (x) and the (y) have a hydroxy group and these are combined with a binder [for example, the diisocyanate (4)], and a reaction wherein when one of the (x) and the (y) is a resin having a hydroxy group and the other is a resin having an isocyanate group, these are combined without using any binder. The addition reaction can be performed at a reaction temperature of 80° C. to 150° C. by dissolving the (x) and the (y) in a solvent in which both the (x) and the (y) are soluble, and, as necessary, adding a binder.

When the crystalline resins (a) is a block resin composed of the (x) and the (y), the content of the (x) in the (a) is preferably 50 to 99% by weight, more preferably 55 to 98% by weight, particularly preferably 60 to 95% by weight, and most preferably 62 to 80% by weight. If the content of the (x) is within the above range, the crystallinity of the (a) is not impaired and a toner is improved in low temperature fixing ability, storage stability, and glossiness, which are desirable.

It is preferable from the viewpoints of low temperature fixing ability and heat resistant storage stability that at least one of the crystalline resins (a) is a resin having a crystalline portion (x) and a urethane linkage.

Examples of the resin having a crystalline portion (x) and a urethane linkage include one in which the crystalline polyurethane resin (a2), the (a) is a resin constituted of only a crystalline portion (x) and the (x) has a urethane linkage, and one in which the (a) is a block resin constituted of a crystalline portion (x) and a noncrystalline portion (y) and the (x) and the (y) are combined with a urethane linkage.

The crystalline resin (a) is preferably one having a total endotherm of 20 to 150 J/g, more preferably 30 to 120 J/g, and particularly preferably 40 to 100 J/g from the viewpoint of heat resistant storage stability.

The total endotherm of the (a) can be measured by the following method.

<Method for Measuring Total Endotherm ΔH of (a)>

The total endotherm ΔH is measured by using a differential scanning calorimeter "DSC Q1000" (manufactured by TA Instruments) under the following conditions.

Temperature elevation rate: 10° C./min.

Measurement starting temperature: 20° C.

Measurement ending temperature: 180° C.

Temperature correction for the detector of the device is done using the melting points of indium and zinc and correction of the amount of heat is done using the heat of fusion of indium.

Specifically, about 5 mg of sample is weighed precisely and put into a silver pan, and then endotherm measurement is performed once to obtain a DSC curve. ΔH is determined from this DSC curve. An empty silver pan is used as a reference.

The Mn of the crystalline resin (a) is preferably 1,000 to 5,000,000, and more preferably 2,000 to 500,000.

The Mn and the Mw of a resin in the present invention can be measured under the following conditions using gel permeation chromatography (GPC).

Device (one example): "HLC-8120" [manufactured by [TOSOH Corporation]

Column (one example): "TSK GEL GMH6" [manufactured by Tosoh Corporation], two columns Measurement temperature: 40° C.

Sample solution: 0.25% by weight solution in tetrahydrofuran (par avance filtering off insolubles with a glass filter)

Solution injection amount: 100 μl

Detecting apparatus: Refraction index detector

Standard substance: standard polystyrene (TSK standard POLYSTYRENE) 12 points (molecular weight: 500, 1,050, 2,800, 5,970, 9,100, 18,100, 37,900, 96,400, 190,000, 355,000, 1,090,000, 2,890,000) [produced by TOSOH Corporation]

The solubility parameter (hereinafter abbreviated as SP value) of the crystalline resin (a) is preferably 7 to 18 $(cal/cm^3)^{1/2}$, more preferably 8 to 16 $(cal/cm^3)^{1/2}$, and particularly preferably 9 to 14 $(cal/cm^3)^{1/2}$.

The SP value in the present invention can be calculable by the method of Fedors [Polym. Eng. Sci. 14(2), 152 (1974)].

The glass transition temperature (hereinafter abbreviated as Tg) of the crystalline resin (a) is preferably 20 to 200° C., and more preferably 40° C. to 150° C. Tg can be measured by the method (DSC) prescribed in ASTM D3418-82 by using "DSC20, SSC/580" [manufactured by Seiko Instruments, Inc.].

Although the crystalline resin (A) may be used alone for the toner binder of the present invention, the above-described noncrystalline resin (b) also may be used in combination with the (A).

The content of the crystalline resin (A) in the toner binder based on the weight of the toner binder is preferably 51% by weight or more, more preferably 60% by weight or more, and particularly preferably 70% by weight or more.

The noncrystalline resin (b) in the present invention may be one prepared from a precursor (b0) thereof.

The precursor (b0) is not particularly restricted as long as it can be converted into the resin (b) via a chemical reaction; when the (b) is a noncrystalline polyester resin (b1), a noncrystalline polyurethane resin (b2), a noncrystalline polyurea resin (b3), or a noncrystalline epoxy resin (b5), the (b0) may be a combination of a prepolymer (a) having a reactive group and a curing agent (β).

When the (b) is a vinyl resin (b4), examples of the (b0) include the monomers (5) to (13) described above.

Of the (b0), preferred from the viewpoint of productivity is a combination of a prepolymer (α) having a reactive group and a curing agent (β).

When the combination of a prepolymer (α) having a reactive group and a curing agent (β) is used as the precursor (b0), the "reactive group" which the (α) has refers to a group capable of reacting with the curing agent (β). In this case, example of the method for forming the (b) by causing the precursor (b0) to react include a method of forming the (b) by causing the (α) to react with the (β) by heating.

Examples of the combination of the reactive group of the reactive group-containing prepolymer (α) with the curing agent (β) include the following [1] and [2].

[1] A combination in which the reactive group of the (α) has is a functional group (a1) capable of reacting with an active hydrogen containing compound and the (β) is an active hydrogen group-containing compound (β1).

[2] A combination in which the reactive group of the (α) is an active hydrogen-containing group (α2) and the (β) is a compound (β2) capable of reacting with an active hydrogen-containing group.

In the combination [1], examples of the functional group (a1) capable of reacting with an active hydrogen compound include an isocyanate group (α1a), a blocking isocyanate group (α1b), an epoxy group (α1c), an acid anhydride group (α1d), and an acid halide group (α1e). Preferred of these are (α1a), (α1b), and (α1c), and the (α1a) and the (α1b) are more preferred.

The blocking isocyanate group (α1b) refers to an isocyanate group blocked with a blocking agent.

Examples of the blocking agent include oximes (e.g., acetoxime, methyl isobutyl ketoxime, diethyl ketoxime, cyclopentanone oxime, cyclohexanone oxime and methyl ethyl ketoxime), lactams (e.g., γ-butyrolactam, ϵ-caprolactam, and γ-valerolactam), aliphatic alcohols having 1 to 20 carbon atoms (e.g., ethanol, methanol, and octanol), phenols (e.g., phenol, m-cresol, xylenol, and nonylphenol), active methylene compounds (e.g., acetylacetone, ethyl malonate, and ethyl acetoacetate), basic nitrogen-containing compounds (e.g., N,N-diethylhydroxylamine, 2-hydroxypiridine, pyridine N-oxide, and 2-mercaptopyridine), and mixtures of two or more of them.

Of these, oximes are preferred, and methyl ethyl ketoxime is more preferred.

Examples the constituent units of the reactive group-containing prepolymer (α) include polyether (αv), polyester (αw), epoxy resin (αx), polyurethane (αy), and polyurea (αz).

Examples of the polyether (αv) include polyethylene oxide, polypropylene oxide, and polybutylene oxide.

Examples of the polyester (αw) include noncrystalline polyester resin (B1).

Examples of the epoxy resin (αx) include addition condensates of bisphenols (e.g., bisphenol A, bisphenol F, and bisphenol S) with epichlorohydrin.

Examples of the polyurethane (αy) include polyaddition products of a diol (1) with a diisocyanate (4), and polyaddition products of a polyester (αw) with a diisocyanate (4).

Examples of the polyurea (αz) include polyaddition products of a diamine (3) with a diisocyanate (4).

Examples of a method for causing the polyether (αv), the polyester (αw), the epoxy resin (αx), the polyurethane (αy), the polyurea (αz), and the like to contain a reactive group include

[1] a method of allowing a functional group of a constituent component to remain in an end thereof by using one of two or more constituent components excessively, and

[2] a method of allowing a functional group of a constituent component to remain in an end thereof by using one of two or more constituent components excessively, and further causing to react a compound having a functional group capable of reacting with the remaining functional group and a reactive group.

In the above method [1], a hydroxyl group-containing polyester prepolymer, a carboxyl group-containing polyester prepolymer, an acid halide group-containing polyester prepolymer, a hydroxyl group-containing epoxy resin prepolymer, an epoxy group-containing epoxy resin prepolymer, a hydroxyl group-containing polyurethane prepolymer, an isocyanate group-containing polyurethane prepolymer, or the like can be obtained.

As to the proportions of the constituent components, in the case of, for example, a hydroxyl group-containing polyester prepolymer, the ratio of the polyol component to the polycarboxylic acid, expressed by the equivalent ratio [OH]/[COOH] of hydroxyl groups [OH] to carboxyl groups [COOH], is preferably from 2/1 to 1/1, more preferably from 1.5/1 to 1/1, and particularly preferably from 1.3/1 to 1.02/1. Also in the case of a prepolymer having a different backbone or a different terminal group, only the constituent components vary but the ratio thereof is the same as described above.

In the above method [2], by reacting a polyisocyanate with the prepolymer obtained by the above method [1], an isocyanate group-containing prepolymer is obtained, by causing a blocked polyisocyanate to react, a blocked isocyanate group-containing prepolymer is obtained, by causing a polyepoxide to react, an epoxy group-containing prepolymer is obtained, and by causing a polyacid anhydride to react, an acid anhydride group-containing prepolymer is obtained.

As to the amount of the compound containing a functional group and a reactive group to be used, for example, in the case of, for example, obtaining an isocyanate group-containing polyester prepolymer by causing a polyisocyanate to react with a hydroxyl group-containing polyester, the proportion of the polyisocyanate is preferably from 5/1 to 1/1, more preferably from 4/1 to 1.2/1, and particularly preferably from 2.5/1 to 1.5/1 as expressed by the equivalent ratio [NCO]/[OH] of the isocyanate groups [NCO] to the hydroxyl groups [OH] of the hydroxyl group-containing polyester. Also in the case of a prepolymer having a different backbone or a different terminal group, only the constituent components vary but the ratio thereof is the same as described above.

The number of reactive groups contained in the reactive group-containing prepolymer (α) per molecule is preferably one or more, more preferably 1.5 to 3 on average, and particularly preferably 1.8 to 2.5 on average. Within the above ranges, the molecular weight of the cured product obtained by causing the prepolymer to react with the curing agent (β) is increased.

The Mn of the reactive group-containing prepolymer (α) is preferably 500 to 30,000, more preferably 1,000 to 20,000, and particularly preferably 2,000 to 10,000.

The Mw of the reactive group-containing prepolymer (a) is preferably 1,000 to 50,000, more preferably 2,000 to 40,000, and particularly preferably 4,000 to 20,000.

Examples of the active hydrogen group-containing compound (β1) include a diamine (β1a), a diol (β1b), a dimercaptan (β1c), which optionally have been blocked with an eliminable compound, and water. Of these, (β1a), (β1b) and water are preferred, (β1a) and water are more preferred, and blocked polyamines and water are particularly preferred.

Examples of (β1a) include the same compounds disclosed for the diamine (3). Preferred as (β1a) are 4,4'-diaminodiphenylmethane, xylylenediamine, isophoronediamine, ethylenediamine, diethylenetriamine, triethylenetetramine, and mixtures thereof.

Examples of the diol (β1b) include the same compounds described for the diol (1), and preferred ones are also the same.

Examples of the dimercaptan (β1c) include ethylenedithiol, 1,4-butanedithiol, and 1,6-hexanedithiol.

A reaction terminator (βs) may, as necessary, be used together with the active hydrogen group-containing compound (β1). By using a certain proportion of the reaction terminator together with (β1), it is possible to adjust the noncrystalline resin (b) to have a prescribed molecular weight.

Examples of the reaction terminator (βs) include monoamines (e.g., diethylamine, dibutylamine, butylamine, laurylamine, monoethanolamine, and diethanolamine); blocked monoamines (e.g., ketimine compounds); monools (e.g., methanol, ethanol, isopropanol, butanol, and phenol); monomercaptans (e.g., butylmercaptan and laurylmercaptan); monoisocyanates (e.g., laurylisocyanate and phenylisocyanate); and monoepoxides (e.g., butyl glycidyl ether).

Examples of the active hydrogen-containing group (α2) possessed by the reactive group-containing prepolymer (α) in the above combination [2] include an amino group (α2a), a hydroxyl group (an alcoholic hydroxyl group and a phenolic hydroxyl group) (α2b), a mercapto group (α2c), a carboxyl group (α2d), and organic groups (α2e) obtained by blocking these groups with an eliminable compound. Preferred of these are (α2a), (α2b) and (α2e), and (α2b) is more preferred.

Examples of the organic group obtained by blocking an amino group with an eliminable compound include the same groups disclosed for the above-described (β1a).

Examples of the compound (β2) capable of reacting with an active hydrogen-containing group include a diisocyanate (β2a), a polyepoxide (β2b), a polycarboxylic acid (β2c), a polyacid anhydride (β2d), and a polyacid halide (β2e). Preferred of these are (β2a) and (β2b), and (β2a) is more preferred.

Examples of the diisocyanate (β2a) include the same compounds described for the diisocyanate (4), and preferred ones are also the same.

Examples of the diepoxide (β2b) include the same described for the diepoxide of the polyepoxide (14).

Examples of the dicarboxylic acid (β2c) include the same compounds described for the dicarboxylic acid (2), and preferred ones are also the same.

The proportion of the curing agent (β), expressed by the ratio [α]/[β] of the equivalent [α] of the reactive groups in the reactive group-containing prepolymer (A) to the equivalent of the active hydrogen-containing groups in the curing agent (β), is preferably from 1/2 to 2/1, more preferably from 1.5/1 to 1/1.5, and particularly preferably from 1.2/1 to 1/1.2. When the curing agent (β) is water, the water is dealt with as a divalent active hydrogen compound.

The resin particle of the present invention comprises the toner binder of the present invention.

The resin particle of the present invention may comprise a colorant, a mold release agent, a charge control agent, a fluidizing agent, etc. as well as the toner binder of the present invention.

Any dyes, pigments, and the like in use as coloring agents for toners can be used as the colorant. Specific examples thereof include carbon black, iron black, Sudan Black SM, Fast Yellow G, Benzidine Yellow, Solvent Yellow (21, 77, 114, etc.), Pigment Yellow (12, 14, 17, 83, etc.), Indofast Orange, Irgazin Red, paranitroaniline red, Toluidine Red, Solvent Red (17, 49, 128, 5, 13, 22, 48.2, etc.), Disperse Red, Carmine FB, Pigment Orange R, Lake Red 2G, Rhodamine FB, Rhodamine B Lake, Methyl Violet B Lake, phthalocyanine blue, Solvent Blue (25, 94, 60, 15·3, etc.), Pigment Blue, Brilliant Green, phthalocyanine green, Oil Yellow GG, Kayaset YG, Orasol Brown B, and Oil Pink OP; these can be used singly or two or more of them can be used in mixture. As necessary, magnetic powders (powders of ferromagnetic metals such as iron, cobalt and nickel, or such compounds as magnetite, hematite, and ferrite) may be added for serving also as a colorant. The content of the colorant is preferably 0.1 to 40 parts by weight, and more preferably 0.5 to 10 parts by weight based upon 100 parts by weight of the toner binder. When a magnetic powder is used, the content thereof is preferably 20 to 150 parts by weight, and more preferably 40 to 120 parts by weight.

Examples of the mold release agent preferably include one having a softening point of 50 to 170° C., and examples thereof include polyolefin wax, natural wax (e.g., carnauba wax, montan wax, paraffin wax, and rice wax), aliphatic alcohols having 30 to 50 carbon atoms (e.g., triacontanol), fatty acids having 30 to 50 carbon atoms (e.g., triacontan carboxylic acid), and mixtures thereof.

Examples of the polyolefin wax include (co)polymers of olefins (e.g., ethylene, propylene, 1-butene, isobutylene, 1-hexene, 1-dodecene, 1-octadecenes, and mixtures thereof) [including olefines obtained via (co)polymerization and thermally degraded polyolefins], oxides prepared with oxygen and/or ozone from (co)polymers of olefins, maleic acid-modified olefin (co)polymers [e.g., products modified with maleic acid or a derivative thereof (maleic anhydride, monomethyl maleate, monobutyl maleate, dimethyl maleate, etc.)], copolymers of an olefin with an unsaturated carboxylic acid [e.g., (meth)acrylic acid, itaconic acid, and maleic anhydride] and/or an unsaturated carboxylic acid alkyl ester [e.g., alkyl (meth)acrylates (the alkyl having 1 to 18 carbon atoms) ester, alkyl maleate (the alkyl having 1 to 18 carbon atoms) ester], etc., polymethylenes (e.g., Fischer Tropsch waxes, such as Sasol waxes), fatty acid metal salts (calcium stearate, and the like), and fatty acid esters (behenyl behenate, and the like).

Examples of the charge control agent include nigrosine dyes, triphenylmethane dyes containing a tertiary amine as a side chain, quaternary ammonium salts, polyamine resins, imidazole derivatives, quaternary ammonium salt group-containing polymers, metal-containing azo dyes, copper phthalocyanine dyes, salicylic acid metal salts, boron complexes of benzilic acid, sulfonic acid group-containing polymers, fluorine-containing polymers, halogen-substituted aromatic ring-containing polymers, metal complexes of alkyl derivatives of salicylic acid, and cetyltrimethylammonium bromide.

Examples of the fluidizing agent include colloidal silica, alumina powder, titanium oxide powder, calcium carbonate powder, barium titanate, magnesium titanate, calcium titanate, strontium titanate, zinc oxide, quartz sand, clay, mica, wollastonite, diatom earth, chromium oxide, cerium oxide, rouge, antimony trioxide, magnesium oxide, zirconium oxide, barium sulfate, and barium carbonate.

The contents of the respective components that constitute the resin particle of the present invention are as follows.

The content of the toner binder is preferably 30 to 97% by weight, more preferably 40 to 95% by weight, and particularly preferably 45 to 92% by weight based on the weight of the resin particle.

The content of the colorant is preferably 0 to 60% by weight, more preferably 0.1 to 55% by weight, and particularly preferably 0.5 to 50% by weight based on the weight of the resin particle.

The content of the mold release agent is preferably 0 to 30% by weight, more preferably 0.5 to 20% by weight, and particularly preferably 1 to 10% by weight based on the weight of the resin particle.

The content of the charge control agent is preferably 0 to 20% by weight, more preferably 0.1 to 10% by weight, and particularly preferably 0.5 to 7.5% by weight based on the weight of the resin particle.

The content of the fluidizing agent is preferably 0 to 10% by weight, more preferably 0 to 5% by weight, and particularly preferably 0.1 to 4% by weight based on the weight of the resin particle.

The resin particle of the present invention can be used as a developer for an electrical latent image after, as necessary, being mixed with carrier particles [e.g., iron powder, glass beads, nickel powder, ferrite, magnetite, and ferrite with the surface thereof having been coated with resin (an acrylic resin, a silicone resin, etc.)]. An electrical latent image can be formed also by rubbing the resin particle with an electrifying blade instead of using carrier particles, and the electric latent image is fixed to a support (paper, polyester film, etc.) by a known heating roll fixing method, etc.

The volume average particle diameter (hereinafter abbreviated as D50) of the resin particle of the present invention is preferably 1 to 15 μm, more preferably 2 to 10 μm, and particularly preferably 3 to 7 μm.

The volume average particle diameter of the resin particle of the present invention can be measured by using a Coulter counter "Multisizer III" (manufactured by Beckman Coulter Inc.).

The method for producing the resin particle of the present invention has no particular limitations, and the resin particle may be one obtained by a known method such as a kneading-pulverization method, an emulsion phase-inversion method, and a polymerization method.

For example, in the case of obtaining a resin particle by a kneading pulverization method, the resin particle can be produced by dry-blending components (other than a fluidizing agent) that constitute the resin particle, melt-kneading them, then coarsely pulverizing them, finally forming particulates by using a jet mill pulverizer or the like, further classifying into final particulates preferably having a volume average particle size within the range of from 1 to 15 μm, and then mixing a fluidizing agent. In the case of obtaining a resin particle by using an emulsion phase-inversion method, the resin particle can be produced by dissolving or dispersing components (other than a fluidizing agent) that constitute the resin particle in an organic solvent, emulsifying them by, for example, the adding water, and separating and then classifying them. The resin particle of the present may be produced also by the method using organic fine particulates disclosed in JP-A-2002-284881.

EXAMPLES

The present invention is further described by examples below, but the present invention is not limited thereto.

Production Example 1

Synthesis of Crystalline Polyester Resin (a1-1)

A reaction vessel equipped with a stirrer, a heating cooling apparatus, a thermometer, a nitrogen introduction tube, and a decompression device was charged with 881 parts by weight of dodecanedioic acid, 475 parts by weight of ethylene glycol, and 0.1 parts by weight of dibutyltin oxide under introduction of nitrogen gas, and after purging with nitrogen by pressure reduction, the temperature was raised to 180° C. and then stirring was performed at this temperature for 6 hours. The temperature was gradually raised to 230° C. under reduced pressure (0.007 to 0.026 MPa) while the stirring was continued, and then the temperature was further maintained for 2 hours. On arrival at a viscous state, the reaction was stopped by cooling to 150° C., thereby affording a crystalline polyester resin (a1-1).

Production Example 2

Synthesis of Crystalline Polyester Resin (a1-2)

A crystalline polyester resin (a1-2) was obtained in the same way as in Production Example 1 except that 881 parts by weight of dodecanedioic acid was changed to 684 parts by weight of sebacic acid, and 475 parts by weight of ethylene glycol was changed to 437 parts by weight of 1,6-hexanediol in Production Example 1.

Production Example 3

Synthesis of Crystalline Polyester Resin (a1-3)

A crystalline polyester resin (a1-3) was obtained in the same way as in Production Example 1 except that 881 parts by weight of dodecanedioic acid was changed to 868 parts by weight of sebacic acid, and 475 parts by weight of ethylene glycol was changed to 532 parts by weight of ethylene glycol in Production Example 1.

Production Example 4

Synthesis of Crystalline Polyurethane Resin (a2-1)

A reaction vessel equipped with a stirrer, a heating cooling apparatus, a thermometer, a nitrogen introduction tube, and a decompression device was charged with 216.0 parts by weight of the crystalline polyester (a1-2), 64.0 parts by weight of diphenylmethane diisocyanate, 20.0 parts by weight of 1,2-propylene glycol, and 300.0 parts by weight of tetrahydrofuran (THF) under introduction of nitrogen. Subsequently, the temperature was raised to 50° C. and then a urethanization reaction was carried out for 15 hours at that temperature, thereby affording a THF solution of a crystalline polyurethane resin (a2-1) having a hydroxyl group at an end thereof, and then THF was distilled off. Thus, the crystalline resin (a2-1) was obtained. The NCO content of (a2-1) was 0% by weight.

Production Example 5

Synthesis of Crystalline Polyurethane Resin (a2-2)

A reaction vessel equipped with a stirrer, a heating cooling apparatus, a thermometer, a nitrogen introduction tube, and a decompression device was charged with 290.0 parts by weight of the crystalline polyester (a1-2), 10.0 parts by weight of hexamethylene diisocyanate, and 300.0 parts by weight of THF under introduction of nitrogen. Subsequently, the temperature was raised to 50° C. and then a urethanization reaction was carried out for 15 hours at that temperature, thereby affording a THF solution of a crystalline polyurethane resin (a2-2) having a hydroxyl group at an end thereof, and then THF was distilled off. Thus, the crystalline resin (a2-2) was obtained. The NCO content of (a2-2) was 0% by weight.

Production Example 6

Synthesis of Crystalline Polyurethane Resin (a2-3)

A reaction vessel equipped with a stirrer, a heating cooling apparatus, a thermometer, a nitrogen introduction tube, and a decompression device was charged with 372.0 parts by weight of the crystalline polyester (a1-1), 29.6 parts by weight of 2,2-dimethylolpropionic acid, 2.4 parts by weight of sodium 3-(2,3-dihydroxypropoxy)-1-propanesulfonate, 93.7 parts by weight of isophorone diisocyanate, and 500 parts by weight of acetone under introduction of nitrogen. Subsequently, the temperature was raised to 90° C. and then a urethanization reaction was carried out for 40 hours at that temperature, thereby affording an acetone solution of a crystalline resin (a2-3) having a hydroxyl group at an end thereof, and then acetone was distilled off. Thus, the crystalline polyurethane resin (a2-3) was obtained. The NCO content of (a2-3) was 0% by weight.

Production Example 7

Production of Crystalline Polyurethane Resin (a2-4)

A reaction vessel equipped with a stirrer, a heating cooling apparatus, a thermometer, a nitrogen introduction tube, and a decompression device was charged with 150.0 parts by weight of a polyester diol composed of 1,4-butanediol and adipic acid "SANESTOR 4620" [produced by Sanyo Chemical Industries, Ltd.], 60.0 parts by weight of xylylene diisocyanate, 90.0 parts by weight of bisphenol A-PO (2 moles) adduct, and 300.0 parts by weight of tetrahydrofuran (THF) under introduction of nitrogen. Subsequently, the temperature was raised to 50° C. and then a urethanization reaction was carried out for 15 hours at that temperature, thereby affording a THF solution of a crystalline polyurethane resin (a2-4) having a hydroxyl group at an end thereof, and then THF was distilled off. Thus, the crystalline polyurethane resin (a2-4) was obtained. The NCO content of (a2-4) was 0% by weight.

Production Example 8

Production of Crystalline Vinyl Resin (a3-1)

A reaction vessel equipped with a stirrer, a heating cooling apparatus, a thermometer, a dropping funnel, and a nitrogen introduction tube was charged with 50 parts by weight of THF, and separately a monomer solution was prepared by stirring and mixing at 40° C., 75 parts by weight of behenyl acrylate, 15 parts by weight of acrylic acid, 10 parts by weight of methyl methacrylate, 50 parts by weight THF, and 0.2 parts by weight of 2,2'-azobis(2,4-dimethylvaleronitrile) that had been fed into a glass beaker, and then the monomer solution was poured into the dropping funnel. After replacing the gas phase of the reaction vessel with nitrogen, the monomer solution was added dropwise at 70° C. for 2 hours in a hermetically sealed condition, followed by maturation at 70° C. for 6 hours, thereby affording a solution of a crystalline vinyl resin (3a-1). Subsequently, THF was distilled off to afford the crystalline vinyl resin (3a-1).

Production Example 9

Synthesis of Crystalline Polyester Resin (b-1)

A reaction vessel equipped with a stirrer, a heating cooling apparatus, a thermometer, a decompression device, and a nitrogen introduction tube was charged with 475 parts by weight (60.5 mol %) of terephthalic acid, 120 parts by weight (15.1 mol %) of isophthalic acid, 105 parts by weight (15.1 mol %) of adipic acid, 300 parts by weight (50.0 mol % with exclusion of 157 parts by weight of the recovery mentioned below) of ethylene glycol, 240 parts by weight (50.0 mol %) of neopentyl glycol, and 0.5 parts by weight of titanium diisopropoxybistriethanol aminate as a polymerization catalyst, and these were caused to react with one another at 210° C. under a nitrogen gas flow for 5 hours while generated water being distilled off, and then further caused to react under a reduced pressure of 0.007 to 0.026 MPa for one hour. Subsequently, 7 parts by weight (1.2 mol %) of benzoic acid was added and then caused to react at 210° C. under normal pressure for 3 hours. Further, to this was added 73 parts by weight (8.0 mol %) of trimellitic anhydride, and after being caused to react at 210° C. under normal pressure for one hour, these were further caused to react under a reduced pressure of 0.026 to 0.052 MPa, and then the resulting matter was taken out upon the arrival of Tm at 145° C., affording a polyester resin (b-1). The (b-1) had an Mw of 8,000, a Tg of 60° C., an acid value of 26, a hydroxyl value of 1, and an SP value of 11.8 $(cal/cm^3)^{1/2}$. The recovered ethylene glycol was 157 parts by weight.

Mol % given within parentheses means the mol % of the material in a carboxylic acid component or in a polyol component. The same is applied hereinafter.

Production Example 10

Synthesis of Crystalline Polyester Resin (b-2)

A reaction vessel equipped with a stirrer, a heating cooling apparatus, a thermometer, a decompression device, and a nitrogen introduction tube was charged with 440 parts by weight (54.7 mol %) of terephthalic acid, 235 parts by weight (28.3 mol %) of isophthalic acid, 7 parts by weight (1.0 mol %) of adipic acid, 30 parts by weight (5.1 mol %) of benzoic acid, 554 parts by weight of ethylene glycol, and 0.5 parts by weight of tetrabutoxy titanate as a polymerization catalyst, and these were caused to react with one another at 210° C. under a nitrogen gas flow for 5 hours while generated water and ethylene glycol being distilled off, and then further caused to react under a reduced pressure of 0.007 to 0.026 MPa for one hour. Subsequently, to this was added 103 parts by weight (10.9 mol %) of trimellitic anhydride, and after being caused to react at 210° C. under normal pressure for one hour, these were further caused to react under a reduced pressure of 0.026 to 0.052 MPa, and then the resulting matter was taken out upon the arrival of Tm at 138° C., affording a polyester resin (b-2). The (b-2) had a Tg of 56° C., an Mw of 4,900, an acid value of 35, a hydroxyl value of 28, a THF-insolubles content of 5% by weight, and an SP value of 12.4 $(cal/cm^3)^{1/2}$. The recovered ethylene glycol was 219 parts by weight.

Production Example 11

Synthesis of Crystalline Polyester Resin (b-3)

A reaction vessel equipped with a stirrer, a heating cooling apparatus, a thermometer, a decompression device, and a nitrogen introduction tube was charged with 567 parts by weight (68.0 mol %) of terephthalic acid, 243 parts by weight (30.0 mol %) of isophthalic acid, 605 parts by weight (85.0 mol % with exclusion of 334 parts by weight of the recovery mentioned below) of ethylene glycol, 80 parts by weight (15.0 mol %) of neopentyl glycol, and 0.5 parts by weight of titanium diisopropoxybistriethanol aminate, and these were caused to react with one another at 210° C. under a nitrogen gas flow for 5 hours while generated water and ethylene glycol being distilled off. Subsequently, to this was added 16 parts by weight (2.0 mol %) of trimellitic anhydride, and after being caused to react at 210° C. under normal pressure for one hour, these were further caused to react under a reduced pressure of 0.026 to 0.052 MPa, and then the resulting matter was taken out upon the arrival of Tm at 138° C., affording a polyester resin (b-3). The (b-3) had a Tg of 61° C., an Mw of 17,000, an acid value of 1, a hydroxyl value of 14, a THF-insolubles content of 3% by weight, and an SP value of 12.1 $(cal/cm^3)^{1/2}$ The recovered ethylene glycol was 334 parts by weight.

Production Example 12

Synthesis of Crystalline Polyester Resin (a'-1)

A reaction vessel equipped with a stirrer, a thermometer, a nitrogen introduction tube, and a decompression device was charged with 574 parts by weight of terephthalic acid, 64 parts by weight of isophthalic acid, 500 parts by weight of 1,6-hexanediol, and 0.1 parts by weight of dibutyltin oxide under introduction of nitrogen gas, and after purging with nitrogen by pressure reduction, the temperature was raised to 180° C. and then stirring was performed at this temperature for 6 hours. Thereafter, the temperature was gradually raised to 230° C. under reduced pressure (0.007 to 0.026 MPa) while the stirring was continued, and then the temperature was further maintained for 2 hours. On arrival at a viscous state, the reaction was stopped by cooling to 150° C., thereby affording a crystalline polyester resin (a'-1).

Production Example 13

Synthesis of Crystalline Polyester Resin (a'-2)

A reaction vessel equipped with a stirrer, a thermometer, a nitrogen introduction tube, and a decompression device was charged with 379 parts by weight of terephthalic acid, 333 parts by weight of adipic acid, 452 parts by weight of 1,4-butanediol, and 0.1 parts by weight of dibutyltin oxide under introduction of nitrogen gas, and after purging with nitrogen by pressure reduction, the temperature was raised to 180° C. and then stirring was performed at this temperature for 6 hours. Thereafter, the temperature was gradually raised to 230° C. under reduced pressure (0.007 to 0.026 MPa) while the stirring was continued, and then the temperature was further maintained for 2 hours. On arrival at a viscous state, the reaction was stopped by cooling to 150° C., thereby affording a crystalline polyester resin (a'-2).

Production Example 14

Synthesis of Crystalline Polyester Resin (b-4)

A reaction vessel equipped with a stirrer, a heating cooling apparatus, a thermometer, a decompression device, and a nitrogen introduction tube was charged with 252 parts by weight (85.1 mol %) of terephthalic acid, 14 parts by weight (5.2 mol %) of adipic acid, 757 parts by weight (100.0 mol o) of a PO 2 mol adduct of bisphenol A, and 0.5 parts by weight of titanium diisopropoxybistriethanol aminate, and these were caused to react with one another at 225° C. under a nitrogen gas flow for 5 hours while generated water being distilled off. Subsequently, to this was added 33 parts by weight (9.7 mol %) of trimellitic anhydride, and after being caused to react under normal pressure for one hour, these were further caused to react under a reduced pressure of 0.026 to 0.052 MPa, and then the resulting matter was taken out upon the arrival of Tm at 120° C., affording a polyester resin (b-4). The (b-4) had a Tg of 63° C., an Mw of 4,900, an acid value of 18, a hydroxyl value of 53, a THF-insolubles content of 2% by weight, and an SP value of 11.2 $(cal/cm^3)^{1/2}$.

For the crystalline resins (a1-1) to (a1-3), (a2-1) to (a2-4), (a3-1), (b-1) to (b-4), and (a'-1) to (a'-2) obtained in Production Examples 1 to 13, their physical properties are shown in Tables 1 and 2.

TABLE 1

| (a), (a') | (a1-1) | (a1-2) | (a1-3) | (a2-1) | (a2-2) | (a2-3) | (a2-4) | (a3-1) | (a'-1) | (a'-2) |
|---|---|---|---|---|---|---|---|---|---|---|
| Ta (° C.) | 84 | 67 | 72 | 60 | 65 | 74 | 45 | 64 | 123 | 106 |
| Total endotherm (J/g) | 150 | 120 | 100 | 60 | 80 | 40 | 60 | 60 | 60 | 50 |
| Content of (x) (% by weight) | 100 | 100 | 100 | 72 | 95 | 74 | 50 | 75 | 100 | 100 |
| Mw | 20,000 | 12,000 | 6,000 | 30,000 | 30,000 | 50,000 | 10,000 | 30,000 | 6,300 | 15,000 |
| Presence of ester group | Present | Present | Present | Present | Present | Present | Present | Present | Present | Present |
| Presence of urethane group | Absent | Absent | Absent | Present | Present | Present | Present | Absent | Absent | Absent |
| Presence of urea group | Absent | Absent | Absent | Present | Present | Present | Present | Absent | Absent | Absent |

TABLE 2

| Noncrystalline resin (b) | (b-1) | (b-2) | (b-3) | (b-4) |
|---|---|---|---|---|
| Tg (° C.) | 60 | 56 | 61 | 63 |
| Mw | 8,000 | 4,900 | 17,000 | 4,900 |
| Acid value (mgKOH/g) | 26 | 35 | 1 | 18 |
| Hydroxyl value | 1 | 28 | 14 | 53 |

Examples 1 to 12

Comparative Examples 1 to 3

By compounding the crystalline polyester resins (a1-1) to (a1-3), the crystalline urethane resins (a2-1) to (a2-4), the crystalline vinyl resin (a3-1), the polyester resins (b-1) to (b-4), and the crystalline polyester resins (a'-1) to (a'-2) obtained in Production Examples 1 to 14 according to the formulations (parts by weight) given in Table 3, toner binders (R-1) to (R-12) and (R'-1) to (R'-3) composed of crystalline resins (A-1) to (A-12) and (A'-1) to (A'-3) were obtained.

TABLE 3

| | | Example 1 | Example 2 | Example 3 | Example 4 | Example 5 | Example 6 | Example 7 | Example 8 | Example 9 | Example 10 | Example 11 | Example 12 | Comparative Example 1 | Comparative Example 2 | Comparative Example 3 |
|---|---|---|---|---|---|---|---|---|---|---|---|---|---|---|---|---|
| Toner binder (R), (R') | | (R-1) | (R-2) | (R-3) | (R-4) | (R-5) | (R-6) | (R-7) | (R-8) | (R-9) | (R-10) | (R-11) | (R-12) | (R'-1) | (R'-2) | (R'-3) |
| Crystalline resin (A), (A') | | (A-1) | (A-2) | (A-3) | (A-4) | (A-5) | (A-6) | (A-7) | (A-8) | (A-9) | (A-10) | (A-11) | (A-12) | (A'-1) | (A'-2) | (A'-3) |
| Crystalline resin (a), (a') | (a1-1) | 10 | 30 | 15 | 10 | 5 | — | — | 2 | 10 | 8 | 10 | 2 | 50 | — | 100 |
| | (a1-2) | — | — | — | — | — | — | — | — | — | 1 | — | — | — | — | — |
| | (a1-3) | — | 70 | — | — | — | — | — | — | — | 1 | — | — | — | — | — |
| | (a2-1) | 50 | — | 85 | 80 | 40 | 80 | — | — | 85 | 90 | 20 | 13 | — | — | — |
| | (a2-2) | — | — | — | — | — | 15 | 50 | — | — | — | — | — | — | — | — |
| | (a2-3) | — | — | — | — | — | — | 50 | — | — | — | — | — | — | — | — |
| | (a2-4) | — | — | — | — | — | — | — | 98 | — | — | — | — | — | 50 | — |
| | (a3-1) | — | — | — | — | — | 5 | — | — | — | — | — | — | — | — | — |
| | (a'-1) | — | — | — | — | — | — | — | — | — | — | — | — | 50 | — | — |
| | (a'-2) | — | — | — | — | — | — | — | — | — | — | — | — | — | 50 | — |
| Crystalline resin (b) | (b-1) | 40 | — | — | — | — | — | — | — | 5 | — | — | — | — | — | — |
| | (b-2) | — | — | — | 10 | — | — | — | — | — | — | — | — | — | — | — |
| | (b-3) | — | — | — | — | 55 | — | — | — | — | — | — | — | — | — | — |
| | (b-4) | — | — | — | — | — | — | — | — | — | — | 70 | 85 | — | — | — |
| The number of crystalline resins | | 2 | 2 | 2 | 2 | 2 | 3 | 2 | 2 | 2 | 4 | 2 | 2 | 2 | 2 | 1 |
| TaMax (° C.) | | 84 | 84 | 84 | 84 | 84 | 65 | 74 | 84 | 84 | 84 | 84 | 84 | 123 | 106 | 84 |
| TaMin (° C.) | | 60 | 72 | 60 | 60 | 60 | 60 | 65 | 45 | 60 | 60 | 60 | 60 | 84 | 45 | 84 |
| TaMax − TaMin (° C.) | | 24 | 12 | 24 | 24 | 24 | 5 | 9 | 39 | 24 | 24 | 24 | 24 | 39 | 61 | — |
| Tup (° C.) | | 60 | 70 | 60 | 60 | 60 | 60 | 70 | 50 | 60 | 60 | 60 | 60 | 110 | 100 | 84 |
| Tdown (° C.) | | 40 | 67 | 35 | 34 | 34 | 35 | 65 | 30 | 35 | 45 | 34 | 45 | 70 | 45 | 80 |
| Tup − Tdown (° C.) | | 20 | 3 | 25 | 26 | 26 | 25 | 5 | 20 | 25 | 15 | 26 | 15 | 40 | 55 | 4 |

Production Example 15

Production of Fine Particulate Dispersion Liquid 1

A reaction vessel equipped with a stirrer, a heating cooling apparatus, a thermometer, a cooling tube, and a nitrogen introduction tube was charged with 690.0 parts by weight of water, 9.0 parts by weight of methacrylic acid ethylene oxide adduct sulfate sodium salt "Eleminol RS-30" [produced by Sanyo Chemical Industries, Ltd.], 90.0 parts by weight of styrene, 90.0 parts by weight of methacrylic acid, 110.0 parts by weight of butyl acrylate, and 1.0 part by weight of ammonium persulfate, which were stirred at 350 rpm for 15 minutes to obtain a white emulsion. Subsequently, the temperature was raised to 75° C. and a reaction was carried out at this temperature for 5 hours. Furthermore, 30 parts by weight of a 1% aqueous solution of ammonium persulfate was added, and the mixture was matured at 75° C. for 5 hours, affording [fine particulate dispersion liquid 1] of a vinyl resin (a styrene-methacrylic acid-butyl acrylate-methacrylic acid ethylene oxide adduct sulfate sodium salt copolymer). The volume average particle diameter of the particles dispersed in fine particulate dispersion liquid 1 was measured with a laser diffraction/scattering type particle size distribution analyzer "LA-920" [manufactured by HORIBA, Ltd.] to be 0.1 μm. In addition, part of [fine particulate dispersion liquid 1] was taken out and Tg and Mw were measured. The Tg was 65° C. and the Mw was 150,000.

Production Example 16

Production of Fine Particulate Dispersion Liquid 2

A reaction vessel equipped with a stirrer, a heating cooling apparatus, a thermometer, a cooling tube, a dropping funnel, and a nitrogen introduction tube was charged with 500 parts by weight of toluene. Separately, a monomer solution was prepared by charging 350 parts by weight of toluene, 150 parts by weight of "BLEMMER VA" [behenyl acrylate, produced by NOF Corporation], and 7.5 parts by weight of azobisisobutyronitrile (AIBN) into a glass beaker, and stirring and mixing them at 20° C., and then the monomer solution was poured into the dropping funnel. After replacing the gas phase of the reaction container with nitrogen, the monomer solution was dropped for 2 hours at 80° C. in a hermetically-sealed condition, and aged at 85° C. for 2 hours from the end of the dropping, and then toluene was removed for 3 hours at 130° C. under reduced pressure (0.007 to 0.026 MPa), affording an acrylic crystalline resin. This resin had a melting point of 65° C. and an Mn of 50,000.

After mixing 700 parts by weight of n-hexane and 300 parts by weight of the above-described acrylic crystalline resin, grinding was performed using zirconia beads having a particle diameter of 0.3 mm by using a beads mill "DYNO-MILL MULTI-LAB" [manufactured by Shinmaru Enterprises Corporation], affording milky white [fine particulate dispersion liquid 2]. This dispersion liquid had a volume average particle diameter of 0.3 μm.

Production Example 17

Production of Colorant Dispersion Liquid

A reaction vessel equipped with a stirrer, a heating cooling apparatus, a thermometer, a cooling tube, and a nitrogen introduction tube was charged with 557 parts by weight (17.5 parts by mol) of propylene glycol, 569 parts by weight (7.0 parts by mol) of dimethyl terephthalate, 184 parts by weight (3.0 parts by mol) of adipic acid, and 3 parts by weight of tetrabutoxytitanate as a condensation catalyst, these were caused to react with one another at 180° C. under a nitrogen gas flow for 8 hours while generated methanol being distilled off. Subsequently, a reaction was performed for 4 hours under a nitrogen gas flow while the temperature was gradually raised to 230° C. and generated propylene glycol and water were distilled off, and further the reaction was performed under a reduced pressure of 0.007 to 0.026 MPa for one hour. The recovered propylene glycol was 175 parts by weight (5.5 parts by mol). Subsequently, after cooling to 180° C., 121 parts by weight (1.5 parts by mol) of trimellitic anhydride was added, and after being allowed to react in a hermetically sealed condition under normal pressure for 2 hours, this was further caused to react under normal pressure at 220° C. until the softening point reached 180° C., affording a polyester resin (Mn=8,500).

A beaker was charged with 20 parts by weight of copper phthalocyanine, 4 parts by weight of a colorant dispersant "SOLSPERSE 28000" [produced by Avecia Co., Ltd.], 20 parts by weight of the polyester resin obtained, and 56 parts by weight of ethyl acetate, which were then uniformly dispersed by stirring, and subsequently copper phthalocyanine was microdispersed with a beads mill, affording a colorant dispersion liquid. The volume average particle diameter of the colorant dispersion measured with "LA-920" was 0.2 μm.

Production Example 18

Production of Modified Wax

A pressure-resistant reaction vessel equipped with a stirrer, a heating cooling apparatus, a thermometer, and a dropping cylinder was charged with 454 parts by weight of xylene and 150 parts by weight of low molecular weight polyethylene "SANWAX LEL-400" [softening point: 128° C., produced by Sanyo Chemical Industries, Ltd.]. After nitrogen replacement, the temperature was raised to 170° C. under stirring and then a mixed solution of 595 parts by weight of styrene, 255 parts by weight of methyl methacrylate, 34 parts by weight of di-tert-butylperoxyhexahydroterephthalate, and 119 parts by weight of xylene was dropped for 3 hours at that temperature, and then the resultant was held at the same temperature for 30 minutes. Subsequently, xylene was distilled off under a reduced pressure of 0.039 MPa, affording a modified wax. The graft chain of the modified wax had an SP value of 10.35 $(cal/cm^3)^{1/2}$, an Mn of 1,900, an Mw of 5,200, and a Tg of 56.9° C.

Production Example 19

Production of Mold Release Agent Dispersion Liquid

A reaction vessel equipped with a stirrer, a heating cooling apparatus, a cooling tube, and a thermometer was charged with 10 parts by weight of paraffin wax "HNP-9" [temperature of peak with maximum heat of fusion: 73° C., produced by Nippon Seiro Co., Ltd.], 1 part by weight of modified wax afforded in Production Example 18, and 33 parts by weight of ethyl acetate. The temperature was raised to 78° C. under stirring, and stirring was performed at this temperature for 30 minutes, followed by cooling to 30° C. for one hour, thereby precipitating the paraffin wax in the form of particulates, which were then wet pulverized with an Ultra Visco Mill (manufactured by AIMEX CO., LTD.), affording a mold release agent dispersion liquid. The volume average particle diameter was 0.25 μm.

Production Example 20

Production of Resin Solution (D-1)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 3, and 153 parts by weight of ethyl acetate, and then the toner binder was dissolved homogeneously by stirring. Thus, a resin solution (D-1) was obtained.

Production Example 21

Production of Resin Solution (D-2)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 4, and 153 parts by weight of ethyl acetate, and then the toner binder was dissolved homogeneously by stirring. Thus, a resin solution (D-2) was obtained.

Production Example 22

Production of Resin Solution (D-3)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 5, and 153 parts by weight of ethyl acetate, and then the toner binder was dissolved homogeneously by stirring. Thus, a resin solution (D-3) was obtained.

Production Example 23

Production of Resin Solution (D-4)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 6, and 153 parts by weight of ethyl acetate, and then the toner binder was dissolved homogeneously by stirring. Thus, a resin solution (D-4) was obtained.

Production Example 24

Production of Resin Solution (D-5)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 7, and 153 parts by weight of ethyl acetate, and then the toner binder was dissolved homogeneously by stirring. Thus, a resin solution (D-5) was obtained.

Production Example 25

Production of Resin Solution (D-6)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 8, and 153 parts by weight of ethyl acetate, and then the toner binder was dissolved homogeneously by stirring. Thus, a resin solution (D-6) was obtained.

Production Example 26

Production of Resin Solution (D-7)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Example 9, and 153 parts by weight of ethyl acetate, and then the toner binder was dissolved homogeneously by stirring. Thus, a resin solution (D-7) was obtained.

Production Example 27

Production of Resin Solution (D-8)

A reaction vessel equipped with a stirrer and a thermometer was charged with 30 parts by weight of a colorant dispersion liquid, 140 parts by weight of a mold release agent dispersion liquid, 100 parts by weight of the toner binder of Example 10, and 153 parts by weight of ethyl acetate, and then the toner binder was dissolved homogeneously by stirring. Thus, a resin solution (D-8) was obtained.

Production Example 28

Production of Resin Solution (D-9)

A reaction vessel equipped with a stirrer and a thermometer was charged with 30 parts by weight of a colorant dispersion liquid, 140 parts by weight of a mold release agent dispersion liquid, 100 parts by weight of the toner binder of Example 11, and 153 parts by weight of ethyl acetate, and then the toner binder was dissolved homogeneously by stirring. Thus, a resin solution (D-9) was obtained.

Production Example 29

Production of Resin Solution (D-10)

A reaction vessel equipped with a stirrer and a thermometer was charged with 30 parts by weight of a colorant dispersion liquid, 140 parts by weight of a mold release agent dispersion liquid, 100 parts by weight of the toner binder of Example 12, and 153 parts by weight of ethyl acetate, and then the toner binder was dissolved homogeneously by stirring. Thus, a resin solution (D-10) was obtained.

Comparative Production Example 6

Production of Resin Solution (D'-1)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Comparative Example 1, and 153 parts by weight of ethyl acetate, and then the toner binder was dissolved homogeneously by stirring. Thus, a resin solution (D'-1) was obtained.

Comparative Production Example 7

Production of Resin Solution (D'-2)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Comparative Example 2, and 153 parts by weight of ethyl acetate, and then the toner binder was dissolved homogeneously by stirring. Thus, a resin solution (D'-2) was obtained.

Comparative Production Example 8

Production of Resin Solution (D'-3)

A reaction vessel equipped with a stirrer and a thermometer was charged with 30 parts by weight of a colorant dispersion liquid, 140 parts by weight of a mold release agent dispersion liquid, 100 parts by weight of the toner binder obtained in Comparative Example 3, and 153 parts by weight of ethyl acetate, and then the toner binder was dissolved homogeneously by stirring. Thus, a resin solution (D'-3) was obtained.

The compositions of the resin solutions (D-1) to (D-10) and (D'-1) to (D'-3) obtained in Production Examples 19 to 29 and Comparative Production Examples 6 to 8 are shown in Table 4.

TABLE 4

| Resin solution | | (D-1) | (D-2) | (D-3) | (D-4) | (D-5) | (D-6) | (D-7) | (D-8) | (D-9) | (D-10) | (D'-1) | (D'-2) | (D'-3) |
|---|---|---|---|---|---|---|---|---|---|---|---|---|---|---|
| Colorant dispersion liquid | | 30 | 30 | 30 | 30 | 30 | 30 | 30 | 30 | 30 | 30 | 30 | 30 | 30 |
| Mold release agent dispersion liquid | | 140 | 140 | 140 | 140 | 140 | 140 | 140 | 140 | 140 | 140 | 140 | 140 | 140 |
| Toner binder (R), (R') | (R-3) | 100 | — | — | — | — | — | — | — | — | — | — | — | — |
| | (R-4) | — | 100 | — | — | — | — | — | — | — | — | — | — | — |
| | (R-5) | — | — | 100 | — | — | — | — | — | — | — | — | — | — |
| | (R-6) | — | — | — | 100 | — | — | — | — | — | — | — | — | — |
| | (R-7) | — | — | — | — | 100 | — | — | — | — | — | — | — | — |
| | (R-8) | — | — | — | — | — | 100 | — | — | — | — | — | — | — |
| | (R-9) | — | — | — | — | — | — | 100 | — | — | — | — | — | — |
| | (R-10) | — | — | — | — | — | — | — | 100 | — | — | — | — | — |
| | (R-11) | — | — | — | — | — | — | — | — | 100 | — | — | — | — |
| | (R-12) | — | — | — | — | — | — | — | — | — | 100 | — | — | — |

TABLE 4-continued

| Resin solution | (D-1) | (D-2) | (D-3) | (D-4) | (D-5) | (D-6) | (D-7) | (D-8) | (D-9) | (D-10) | (D'-1) | (D'-2) | (D'-3) |
|---|---|---|---|---|---|---|---|---|---|---|---|---|---|
| (R'-1) | — | — | — | — | — | — | — | — | — | — | 100 | — | — |
| (R'-2) | — | — | — | — | — | — | — | — | — | — | — | 100 | — |
| (R'-3) | — | — | — | — | — | — | — | — | — | — | — | — | 100 |
| Ethyl acetate | 153 | 153 | 153 | 153 | 153 | 153 | 153 | 153 | 153 | 153 | 153 | 153 | 153 |

Production Example 30

Preparation of Precursor (b0-1) Solution

A reaction vessel equipped with a stirrer, a heating cooling apparatus, a thermometer, a cooling tube, and a nitrogen introduction tube was charged with 681 parts by weight of an EO 2 mol adduct of bisphenol A, 81 parts by weight of a PO 2 mol adduct of bisphenol A, 275 parts by weight of terephthalic acid, 7 parts by weight of adipic acid, 22 parts by weight of trimellitic anhydride, and 2 parts by weight of dibutyltin oxide, followed by a dehydration reaction performed under normal pressure at 230° C. for 5 hours, and then a dehydration reaction was performed at a reduced pressure of 0.01 to 0.03 MPa for 5 hours, affording a polyester resin.

A pressure-resistant reaction vessel equipped with a stirrer, a heating cooling apparatus, and a thermometer was charged with 350 parts by weight of a polyester resins, 50 parts by weight of isophorone diisocyanate, 600 parts by weight of ethyl acetate, and 0.5 parts by weight of ion exchange water, and a reaction was performed in a hermetically sealed condition at 90° C. for 5 hours, affording a solution of a precursor (b0-1) having an isocyanate group at a terminal of the molecule. The (b0-1) solution had a urethane group concentration of 5.2% by weight and a urea group concentration of 0.3% by weight. The solid concentration was 45% by weight.

Example 13

Production of Resin Particle (S-1)

One hundred parts by weight of the toner binder (R-1), 8 parts by weight of carbon black "MA-100" [produced by Mitsubishi Chemical Inc.], 5 parts by weight of carnauba wax, and 1 part by weight of a charge controlling agent "T-77" [produced by Hodogaya Chemical Co., Ltd.] were added and preliminarily mixed with a Henschel mixer "FM10B" [manufactured by Mitsui Miike Chemical Engineering Machinery, Co., Ltd.], and then kneaded with a twin screw kneader "PCM-30" [manufactured by Ikegai Corp.]. Subsequently, after being finely pulverized with a supersonic jet pulverizer "Labo Jet" [manufactured by Nippon Pneumatic Mfg. Co., Ltd.], the resulting particles were classified with an airflow classifier "MDS-I" [manufactured by Nippon Pneumatic Mfg. Co., Ltd.], affording a resin particle having a D50 of 8 μm. Subsequently, 0.5 parts by weight of colloidal silica "Aerosil R972" [produced by Nippon Aerosil Co., Ltd.] was mixed with 100 parts by weight of the resin particle by using a sample mill, affording a resin particle (S-1) of the present invention.

Example 14

Production of Resin Particle (S-2)

A resin particle (S-2) of the present invention was obtained in the same way as in Example 13 except that 100 parts by weight of the toner binder (R-1) was changed to 100 parts by weight of the toner binder (R-2) in Example 13.

Example 15

Production of Resin Particle (S-3)

To a beaker were added 170.2 parts by weight of ion exchange water, 0.3 parts by weight of [fine particulate dispersion liquid 1], 1 part by weight of sodium carboxymethyl cellulose, 36 parts by weight of a 48.5 weight % aqueous solution of sodium dodecyldiphenyl ether disulfonate "Eleminol MON-7" [produced by Sanyo Chemical Industries, Ltd.], and 15.3 parts by weight of ethyl acetate, which were then stirred to dissolve uniformly. Subsequently, the temperature was raised to 50° C. and 75 parts by weight of the resin solution (D-1) was charged at that temperature under stirring with a TK autohomomixer at 10,000 rpm and was stirred for 2 minutes. Subsequently, this mixed liquid was transferred to a reaction vessel equipped with a stirrer and a thermometer, and ethyl acetate was distilled away until the concentration became 0.5% by weight or less at 50° C., affording an aqueous resin dispersion of a resin particle. Subsequently, washing and filtration were performed, and the resultant was dried at 40° C. for 18 hours to a volatiles content of 0.5% by weight or less, affording a resin particle. Subsequently, 0.05 parts by weight of colloidal silica "Aerosil R972" [produced by Nippon Aerosil Co., Ltd.] was added to 10 parts by weight of the toner particle and mixed with a sample mill, affording a resin particle (S-3) of the present invention.

Example 16

Production of Resin Particle (S-4)

A resin particle (S-4) of the present invention was obtained in the same way as in Example 15 except that 75 parts by weight of the resin solution (D-1) was changed to 75 parts by weight of the resin solution (D-2).

Example 17

Production of Resin Particle (S-5)

A resin particle (S-5) of the present invention was obtained in the same way as in Example 15 except that 75 parts by weight of the resin solution (D-1) was changed to 75 parts by weight of the resin solution (D-3).

Example 18

Production of Resin Particle (S-6)

A resin particle (S-6) of the present invention was obtained in the same way as in Example 15 except that 75 parts by weight of the resin solution (D-1) was changed to 75 parts by weight of the resin solution (D-4).

Example 19

Production of Resin Particle (S-7)

A resin particle (S-7) of the present invention was obtained in the same way as in Example 15 except that 75 parts by weight of the resin solution (D-1) was changed to 75 parts by weight of the resin solution (D-5).

Example 20

Production of Resin Particle (S-8)

A resin particle (S-8) of the present invention was obtained in the same way as in Example 15 except that 75 parts by weight of the resin solution (D-1) was changed to 75 parts by weight of the resin solution (D-6).

Example 21

Production of Resin Particle (S-9)

A beaker was charged with 108 parts by weight of decane and 2.1 parts by weight of [fine particulate dispersion liquid 2], and then they were stirred to dissolve homogeneously. Subsequently, the temperature was raised to 50° C. and 75 parts by weight of the resin solution (D-7) was charged at that temperature under stirring with a TK autohomomixer at 10,000 rpm and was stirred for 2 minutes. Subsequently, this mixed liquid was transferred to a reaction vessel equipped with a stirrer and a thermometer, and ethyl acetate was distilled away until the concentration became 0.5% by weight or less at 50° C., and subsequently, washing and filtration were performed, and the resultant was dried at 40° C. for 18 hours to a volatiles content of 0.5% by weight or less, affording a resin particle. Subsequently, 0.05 parts by weight of colloidal silica "Aerosil R972" [produced by Nippon Aerosil Co., Ltd.] was mixed with 10 parts by weight of the resin particle by using a sample mill, affording a resin particle (S-9) of the present invention.

Example 22

Production of Resin Particle (S-10)

A resin particle (S-10) of the present invention was obtained in the same way as in Example 21 except that 75 parts by weight of the resin solution (D-7) was changed to 75 parts by weight of the resin solution (D-8).

Example 23

Production of Resin Particle (S-11)

A resin particle (S-11) of the present invention was obtained in the same way as in Example 21 except that 75 parts by weight of the resin solution (D-7) was changed to 75 parts by weight of the resin solution (D-9).

Example 24

Production of Resin Particle (S-12)

A resin particle (S-12) of the present invention was obtained in the same way as in Example 21 except that 75 parts by weight of the resin solution (D-7) was changed to 75 parts by weight of the resin solution (D-10).

Example 25

Production of Resin Particle (S-13)

To a beaker were added 170.2 parts by weight of ion exchange water, 0.3 parts by weight of a fine particulate dispersion liquid, 1 part by weight of sodium carboxymethyl cellulose, 36 parts by weight of a 48.5 weight % aqueous solution of sodium dodecyldiphenyl ether disulfonate "Eleminol MON-7" [produced by Sanyo Chemical Industries, Ltd.], and 15.3 parts by weight of ethyl acetate, which were then stirred to dissolve uniformly. Subsequently, 11.2 parts by weight of the precursor (B0-1) solution, 5.5 parts by weight of a curing agent (β-1), and 63.8 parts by weight of the resin solution (D-9) were charged under stirring with a TK autohomomixer at 10,000 rpm and were stirred for 2 minutes. Subsequently, this mixed liquid was transferred to a reaction vessel equipped with a stirrer, a heating cooling apparatus, a cooling tube, and a thermometer, and ethyl acetate was distilled away until the concentration became 0.5% by weight or less at 50° C., affording an aqueous resin dispersion of a toner particle. Subsequently, washing and filtration were performed, and the resultant was dried at 40° C. for 18 hours to a volatiles content of 0.5% by weight or less, affording a resin particle (S-13) of the present invention.

Example 26

Production of Resin Particle (S-14)

A resin particle (S-14) of the present invention was obtained in the same way as in Example 25 except that 75 parts by weight of the resin solution (D-9) was changed to 75 parts by weight of the resin solution (D-10).

Comparative Example 4

Production of Resin Particle (S'-1)

A resin particle (S'-1) was obtained in the same way as in Example 15 except that 75 parts by weight of the resin solution (D-1) was changed to 75 parts by weight of the resin solution (D'-1).

Comparative Example 2

Production of Resin Particle (S'-2)

A resin particle (S'-2) was obtained in the same way as in Example 15 except that 75 parts by weight of the resin solution (D-1) was changed to 75 parts by weight of the resin solution (D'-2).

Comparative Example 3

Production of Resin Particle (S'-3)

A resin particle (S'-3) was obtained in the same way as in Example 15 except that 75 parts by weight of the resin solution (D-1) was changed to 75 parts by weight of the resin solution (D'-3).

For the resin particles (S-1) to (S-14) and (S'-1) to (S'-3), the volume average particle diameter and the particle size distribution were measured by the following methods and the heat resistant storage stability, the low temperature fixing ability, the hot offset resistance property, and the anti-blocking property of paper were evaluated. Results are shown in Table 5.

[1] Volume Average Particle Diameter, Particle Size Distribution

Each of the resin particles (S-1) to (S-14) and (S'-1) to (S'-3) was dispersed in water, and then the D50 and the particle size distribution were measured with a Coulter counter "Multisizer III" (manufactured by Beckman Coulter Inc.).

[2] Heat Resistant Storage Stability

Each of the resin particles (S-1) to (S-14) and (S'-1) to (S'-3) was left at rest in an atmosphere of 40° C. for one day and then the degree of blocking was judged visually, and the was evaluated the heat resistant storage stability according to the following criteria.

[Evaluation Criteria]

○: No blocking occurred.

X: Blocking occurred.

[3] Low Temperature Fixing Ability

Each of the resin particles (S-1) to (S-14) and (S'-1) to (S'-3) was placed on a paper uniformly in a density of 0.6 mg/cm2 (at this time, in the method of placing the powder on the paper used a printer from which a heat fixing machine has been removed; other methods may be used as long as the powder can be placed uniformly in the above weight density). The temperature (MFT) at which cold offset occurred when the resultant paper was caused to pass through a compression roller at a fixing rate (compression roller circumferential rate) of 213 mm/sec and a fixing pressure (compression roller pressure) of 10 kg/cm$^2$ was measured. A lower temperature at which cold offset occurred means that low temperature fixing ability is better.

[4] Hot Offset Resistance Property

The same evaluation as the above-described low temperature fixing ability was performed, and the presence or absence of hot offset on a fixed image was visually evaluated. The highest temperature at which no hot offset occurred after a passage of a fixing roll was determined as hot offset occurrence temperature (HOT), and HOT—MFT was defined as a fixing temperature range (° C.). A greater fixing temperature range means that the hot offset resistance property is better.

[5] Anti-Blocking Property of Paper

Fixed images prepared during the above-described evaluation of low temperature fixing ability were superimposed while being faced with each other so that the image portion of one fixed image would be superimposed on both the non-image portion and the image portion of the other fixed image, and then the fixed images were left standing for one day in a constant-temperature, constant-humidity chamber at a temperature of 55° C. and a humidity of 50% with a weight placed on the superimposed area so as to apply a load of 80 g/cm$^2$. After being left standing, the degree of image defects of the two superimposed fixed images was judged visually, and the anti-blocking property of paper was evaluated according to the following criteria.

[Evaluation Criteria]

○: Transfer of images was not found in both an image portion and a non-image portion.

X: Since the two superimposed printed materials had adhered to each other to become incapable of being peeled off, serious image damage was caused by peeling off of the materials including the surface layer of paper when the materials were forced to peel off.

TABLE 5

| | Example 13 | Example 14 | Example 15 | Example 16 | Example 17 | Example 18 | Example 19 | Example 20 | Example 21 |
|---|---|---|---|---|---|---|---|---|---|
| Resin particle | (S-1) | (S-2) | (S-3) | (S-4) | (S-5) | (S-6) | (S-7) | (S-8) | (S-9) |
| Volume average particle diameter (μm) | 8.0 | 8.0 | 6.0 | 4.0 | 5.0 | 5.2 | 6.0 | 6.0 | 5.5 |
| Particle size distribution | 1.25 | 1.22 | 1.11 | 1.16 | 1.16 | 1.18 | 1.13 | 1.15 | 1.12 |
| Heat resistant storage stability | ○ | ○ | ○ | ○ | ○ | ○ | ○ | ○ | ○ |
| Low temperature fixing ability (° C.) | 110 | 100 | 90 | 100 | 100 | 100 | 95 | 105 | 105 |
| Hot offset resistance Property (° C.) | 200 | 200 | 200 | 200 | 200 | 200 | 200 | 200 | 200 |
| Anti-blocking property of paper | ○ | ○ | ○ | ○ | ○ | ○ | ○ | ○ | ○ |

| | Example 22 | Example 23 | Example 24 | Example 25 | Example 26 | Comparative Example 1 | Comparative Example 2 | Comparative Example 3 |
|---|---|---|---|---|---|---|---|---|
| Resin particle | (S-10) | (S-11) | (S-12) | (S-13) | (S-14) | (S'-1) | (S'-2) | (S'-3) |
| Volume average particle diameter (μm) | 5.4 | 5.4 | 5.3 | 5.1 | 5.2 | 8.0 | 6.0 | 7.0 |

TABLE 5-continued

| | | | | | | | | |
|---|---|---|---|---|---|---|---|---|
| Particle size distribution | 1.17 | 1.13 | 1.12 | 1.11 | 1.13 | 1.50 | 1.40 | 1.54 |
| Heat resistant storage stability | ○ | ○ | ○ | ○ | ○ | X | X | ○ |
| Low temperature fixing ability (° C.) | 110 | 105 | 95 | 105 | 110 | 150 | 140 | 140 |
| Hot offset resistance Property (° C.) | 200 | 200 | 200 | 200 | 200 | 200 | 200 | 200 |
| Anti-blocking property of paper | ○ | ○ | ○ | ○ | ○ | X | X | X |

What is claimed is:

1. A toner binder comprising a crystalline resin (A), wherein the crystalline resin (A) comprises two or more crystalline resins (a) and the endothermic peak temperature group that is composed of all of the endothermic peak temperatures of the respective two or more crystalline resins (a) has two or more different endothermic peak temperatures.

2. The toner binder according to claim 1, wherein in the endothermic peak temperature group composed of all of the endothermic peak temperatures of the respective two or more crystalline resins (a), the difference between the maximum temperature of the endothermic peaks and the minimum temperature of the endothermic peaks is 3 to 40° C. and the endotherm at the maximum temperature of the endothermic peaks is smaller than the endotherm at the minimum temperature of the endothermic peaks.

3. The toner binder according to claim 1, wherein the endothermic peak temperatures of the respective two or more crystalline resins (a) are 40 to 120° C.

4. The toner binder according to claim 1, wherein in viscoelasticity measurement of the crystalline resin (A), the following condition 1 is satisfied wherein Tup expresses the temperature at which the storage modulus of the crystalline resin (A) becomes $1.0\times10^6$ Pa when the temperature is raised from 30° C. at a rate of 10° C./min and Tdowm expresses the temperature at which the storage modulus of the crystalline resin (A) becomes $1.0\times10^6$ Pa when the temperature is lowered from Tup+20° C. at a rate of 10° C./min $$0° C. < Tup - Tdown \leq 30° C. \quad \text{[Condition 1]}$$

5. The toner binder according to claim 1, wherein at least one of the crystalline resins (a) included in the crystalline resin (A) is a resin comprising a crystalline portion (x) and a urethane linkage.

6. The toner binder according to claim 5, wherein at least one of the crystalline resins (a) included in the crystalline resin (A) is a resin composed only of a crystalline portion (x).

7. The toner binder according to claim 5, wherein at least one of the crystalline resins (a) included in the crystalline resin (A) is a block polymer resin composed of a crystalline portion (x) and a noncrystalline portion (y).

8. The toner binder according to claim 5, wherein the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

9. The toner binder according to claim 1, wherein at least one of the crystalline resins (a) included in the crystalline resin (A) is a resin composed only of a crystalline portion (x).

10. The toner binder according to claim 9, wherein the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

11. The toner binder according to claim 1, wherein at least one of the crystalline resins (a) included in the crystalline resin (A) is a block polymer resin composed of a crystalline portion (x) and a noncrystalline portion (y).

12. The toner binder according to claim 11, wherein the content of the crystalline portion (x) is 50 to 99% by weight based on the weight of the (a).

13. The toner binder according to claim 11, wherein the crystalline portion (x) is a resin selected from the group consisting of a crystalline polyester resin, a crystalline polyurethane resin, a crystalline polyurea resin, a crystalline vinyl resin, a crystalline epoxy resin, a crystalline polyether resin, and composite resins thereof.

14. The toner binder according to claim 1, wherein the content of the crystalline resin (A) based on the weight of the toner binder is 51% by weight or more.

15. A resin particle comprising the toner binder according to claim 1.

* * * * *